US007841686B2

(12) United States Patent
Kyoshima

(10) Patent No.: US 7,841,686 B2
(45) Date of Patent: Nov. 30, 2010

(54) CARTRIDGE, RECORDING APPARATUS, AND METHOD FOR DETERMINING AMOUNT OF RECORDING LIQUID REMAINDER

(75) Inventor: Masayuki Kyoshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 887 days.

(21) Appl. No.: 11/790,497

(22) Filed: Apr. 26, 2007

(65) Prior Publication Data

US 2007/0252858 A1 Nov. 1, 2007

(30) Foreign Application Priority Data

May 1, 2006 (JP) ..... 2006-127471
May 30, 2006 (JP) ..... 2006-149874

(51) Int. Cl.
*B41J 29/393* (2006.01)

(52) U.S. Cl. ..... 347/19; 347/7; 347/14; 347/85

(58) Field of Classification Search ..... 347/5, 347/7, 9, 12, 14, 19, 50, 84–87
See application file for complete search history.

(56) References Cited

U.S. PATENT DOCUMENTS 4,952,947 A 8/1990 Kyoshima ..... 346/140 R
5,867,195 A 2/1999 Kaneko et al. ..... 347/92
6,585,345 B2 * 7/2003 Kosugi ..... 347/19
2003/0214546 A1 11/2003 Hatasa et al. ..... 347/19

FOREIGN PATENT DOCUMENTS

| | | |
|---|---|---|
| CN | 1449922 | 10/2003 |
| JP | 11-320914 | 11/1999 |
| JP | 2003-159808 | 6/2003 |
| JP | 2004-338394 | 12/2004 |

OTHER PUBLICATIONS

Chinese Office Action dated Jun. 19, 2009 from corresponding Chinese Application No. 200710102260.X, and English language translation thereof.

* cited by examiner

*Primary Examiner*—Juanita D Stephens
(74) *Attorney, Agent, or Firm*—Fitzpatrick, Cella, Harper & Scinto

(57) ABSTRACT

A recording apparatus to which a recording liquid accommodating container having a recording liquid accommodating portion is mountable, wherein the recording liquid accommodating container including communicating means for bi-directional wireless communication with the recording apparatus, the recording apparatus including a communication antenna for wireless communication with the communicating means; wherein the communication antenna and the communicating means are adapted to be disposed opposed to each other with the recording liquid accommodating portion interposed therebetween, and wherein it is discriminated depending on a state of wireless communication between the communication antenna and the communicating means whether or not a remaining amount of the recording liquid in the recording liquid accommodating portion is not more than a predetermined amount.

22 Claims, 14 Drawing Sheets

CARTRIDGE, RECORDING APPARATUS, AND METHOD FOR DETERMINING AMOUNT OF RECORDING LIQUID REMAINDER

FIELD OF THE INVENTION AND RELATED ART

The present invention relates to a recording apparatus, a method for determining the amount of recording liquid remainder, in particular, a system for determining the amount of recording liquid remainder in an ink jet printing apparatus.

The present invention also relates to a cartridge which is removably mountable in the main assembly of a recording apparatus, and an ink jet printer in which multiple such cartridges are mounted to enable the printer to record images. In particular, it relates to a wireless communication system for obtaining such information as the cartridge position relative to the cartridge holder, information which is specific to each cartridge.

There have long been known ink jet recording apparatuses which use multiple inks different in color. Some of such ink jet recording apparatuses are structured so that multiple recording liquid containers (ink cartridges) which are filled with multiple inks different in color, one for one, are individually and removably mountable in the main assembly of the recording apparatus, making it possible for any of the multiple recording liquid container in the main assembly of the recording apparatus to be individually replaced, according to the frequency with which the ink in each recording liquid container is used. Thus, these ink jet recording apparatuses make it possible to completely use the ink in each recording liquid container; they can prevent ink from being wasted. In other words, one of their characteristic features is being excellent from the economical standpoint.

An ink jet recording apparatus such as those described above is provided with multiple ink delivery passages; each of the recording liquid containers in the main assembly of the ink jet recording apparatus is connected to the corresponding ink jet head through its own ink delivery passage. Further, it is designed so that when it prints in color, the control portion of its main assembly individually controls, for each color, the processes, such as causing the ink jet head to jet ink.

The quality with which an image is outputted by an ink jet recording apparatus is affected by ink viscosity, manner in which ink bleeds through recording medium, as well as the resolution of the recording head. Therefore, in order to improve the quality with which an ink jet recording apparatus outputs an image, various efforts have been made to improve ink in properties, and also, improve the signals supplied to the recording head to drive the recording head. Further, various efforts have also been made to improve the method for maintaining an ink jet recording apparatus; for example, jetting ink without the presence of recording medium to prevent the nozzles from plugging up, or forcing the recording head to jet ink with the cap on, etc.

Thus, there have been made various proposals regarding the communication between each recording liquid container and the main assembly of an ink jet recording apparatus. According to one of the proposals, each recording liquid container is provided with a memory (storage) chip for storing the data regarding the recording liquid container, and communication is made between each of the recording liquid containers and the main assembly of the ink jet recording apparatus. More specifically, the data in the memory chip of each recording liquid container are read by the main assembly of the recording apparatus, so that an image is printed under the optimal condition. Further, the memory chip is used to store the state of each recording liquid container, and the data regarding the history of the usage of each recording liquid container.

According to the structural arrangement for a semiconductor memory chip disclosed in Japanese Laid-open Patent Applications 11-320914 and 2004-338394, the exchange of the information described above between a recording liquid container and the main assembly of a recording apparatus is carried out with no physical contact between the container and main assembly, that is, wirelessly, more specifically, over radio waves. Wireless communication makes it possible for each recording liquid container and the main assembly of a recording apparatus to communicate even if there is packaging material between the two. In other words, the abovementioned structural arrangement has merits in that not only can it be used to allow the control portion of the main assembly of a recording apparatus to wirelessly access the data in each recording liquid container, but also, the various information in each recording liquid container can be used for other purposes, for example, inventory control carried out during the distribution of recording liquid containers.

Disclosed in Japanese Laid-open Patent Application 11-320914 is another structural arrangement for an semiconductor memory chip which allows each ink cartridge and the main assembly of a printer to exchange information with no contact between the two, that is, over radio waves. Wireless communication makes it possible for an ink cartridge to communicate even while an ink container is in its package. Therefore, not only can it be used for the abovementioned purposes, but also, but also, it can be for the inventory control carried out during the distribution of ink jet cartridges. Further, the structural arrangement which uses radio waves makes it possible for a recording liquid container to exchange information with the counterpart with no problem, even if the carriage is slightly deviant in terms of the position in which it is to be stopped to read the information in the semiconductor memory chip of a specific ink cartridge, or write information into the semiconductor memory chip.

Disclosed in Japanese Laid-open Patent Application 2003-159808 is another method for exchanging information between an ink cartridge and the main assembly of an ink jet recording apparatus, over radio wave. According to this document, in order to ensure that information is reliably exchanged between a specific ink cartridge and the main assembly, the storage means of each ink cartridge is provided with the information regarding the ID of the ink cartridge. Also according to this document, the main assembly of a recording apparatus is provided with a wireless communication system capable of transmitting or receiving data only across a short range (10 mm or so). In operation, the ink cartridge whose information is needed is moved to a location at which its storage element is placed in the transmission-reception range between the storage means and the counter part on the main assembly side, and then, the information is exchanged while the identity of the ink cartridge is continuously confirmed.

A wireless communication system which employs the so-called wireless tag or RFID (Radio Frequency Identification) has long been known. As for the frequency range of the carrier waves for this type of wireless communication system, the mid range, which is no higher than 135 kHz, 13.56 MHz (short wave range), 680-960 MHz (UHF range), and 2.45 GHz (microwave range) are used. In the case of the wireless communication systems whose frequency is in the mid or short range, the electromagnetic phenomenon attributable to the magnetic field which the reading-writing device generates is utilized, and in the case of the wireless communication systems whose frequency is in the microwave range, the electric field energy of the carrier wave is used to generate electric power. The properties, such as range and directionality, of a wireless communication system is affected by the frequency range of the system, and also, by external factors, such as the presence of noises, metallic substances, and water in the adjacencies of the system. Regarding the effects of the presence of water in the adjacencies of the system, the microwave is the highest in the amount by which electromagnetic wave is absorbed by water; it has been known that the presence of water sometimes makes a microwave-based wireless communication system suffer from communication failure.

On the other hand, there have been known various means for detecting the amount of the ink remaining in a recording liquid container in an ink jet recording apparatus. According to one of such means, a recording liquid container is provided with two electrodes which are attached to two locations, one for one, inside the recording liquid container, and the amount of resistance between the two electrodes is measured to determine the amount of the ink remainder in the container. According to another means, the amount of the ink remainder is measured with the use of a device (weight sensor, or the like) capable of measuring the weight of the ink in the recording liquid container. According to another means, the amount of the ink remainder is measured by a device (photo-interrupter sensor, or the like) capable of optically measuring the amount of the ink in a recording liquid container.

Further, it is desired that the control portion of the main assembly of a printer, such as the above described ones, is capable of obtaining the current state and history of each ink cartridge, expiration date, etc., because if the information described above can be obtained with proper timing, the control portion can determine the amount of ink remaining in each ink cartridge and expiration date of each ink cartridge to more precisely control the recording operation and maintenance operation, or offer a user the more detailed information, for example, the information regarding each of the multiple ink cartridges.

In recent years, therefore, various ink cartridges equipped with a memory chip (semiconductor) in which the information regarding an ink jet cartridge and the information obtained from a recording apparatus can be stored have been proposed. In the case of an ink jet printer which employs such an ink cartridge, not only does the control portion of the printer read the information regarding each ink cartridge from the semiconductor memory chip of the ink cartridge, but also, writes the current state of this ink cartridge in the memory chip, over the old data in the chip. Further, during a recording operation, the control portion utilizes the information to control the recording operation, for each color.

However, the ink jet recording apparatuses which employ the conventional means, that is, means in accordance with the prior art, for measuring the amount of the recording liquid remainder in each recording liquid container suffer from the following problems. That is, ink jet recording apparatuses which employ the "electrode method", that is, the method which employs a pair of electrodes to measure the amount of the ink remainder in each ink container, suffer from the problem that each recording liquid container needs to be equipped with a pair of electrodes and the component related thereto, being therefore higher in cost. In the case of the "means for weighing ink", the mechanism, inclusive of the weight sensor, for measuring the ink weight is complicated or substantial in size, adding to the cost of the recording apparatus. Further, the means for optically measuring the ink weight requires a transparent or semitransparent prism or the like member. Therefore, it restricts a recording liquid container in terms of material and shape.

If it is impossible to provide an ink jet recording apparatus with a physical means for measuring the amount of ink remainder in an ink container, an ink jet recording apparatus may be provided with a means for estimating the amount of ink remainder from the cumulative amount of ink consumption, which can be calculated from the cumulative number of the ink droplets jetted from the ink jet recording head. However, this method is affected by the amount by which ink is initially injected into an ink cartridge, nonuniformity in ink droplet volume, and/or the like factors. Because of the background described above, a method for measuring the amount of ink remainder in an ink cartridge, which is nonrestrictive in usage, simple, and inexpensive, has long been sought.

In the case of color printers, such as those described above, the multiple recording heads, which are different in the color of ink they jet, are individually controlled in terms of ink jetting operation. Further, the ink delivery passages for individually supplying the multiple recording heads with ink are long enough to reach from where the ink cartridges are positioned in the main assembly of an ink jet recording apparatus, to where the current position of the recording heads. Therefore, it is customary that the position, into which each of the multiple ink cartridges which are different in the color of the ink they store, is placed in the main assembly of an ink jet recording apparatus, is preset. Thus, when a given ink cartridge in an ink jet recording apparatus needs to be replaced, an operator (user) is required to place a replacement cartridge in its preset position.

However, when two or more ink cartridges in a printer which employs multiple cartridges which are similar in shape need to be replaced, it is possible that replacement ink cartridges will be incorrectly mounted. Thus, it is desired to equip an ink jet recording apparatus with a system or mechanism which makes it possible for the control portion of the ink jet recording apparatus to recognize the state of each ink cartridge in terms of its positional relationship relative to the main assembly of the apparatus. Thus, the structural arrangement described above, that is, providing each ink cartridge with a data storage means as described above is also very useful in dealing with this situation.

However, there have been many situations in which it was difficult for the structural arrangement, such as the one described above, which uses radio wave to transmit information, to accurately determine the state of the multiple ink cartridges juxtaposed in parallel in the main assembly of an ink jet recording apparatus, and the order of the ink cartridges in the main assembly. Further, when there are multiple ink cartridges on a carriage, it is possible that because of the communication range of the wireless communication system, the information from one ink cartridge is likely to mix up with the information from the other ink cartridges; in other words, it is possible for the control portion to read information different from the information it needs.

According to the ink jet recording apparatus design disclosed in Japanese Laid open Patent Application 2003-159808, each ink cartridge stores the information regarding its identification. Therefore, even in the situations, such as the one described above, the control portion can identify each ink cartridge before exchanging various information with each ink cartridge. Thus, it is possible to improve even an ink jet recording apparatus in which multiple ink cartridges are juxtaposed, in terms of the reliability with which information is exchanged between the control portion of the ink jet recording apparatus and each of the ink cartridges therein.

However, in the case of the design disclosed in this patent document, the control portion determines the order of the ink cartridges in the main assembly (carriage) of an ink jet recording apparatus, based on the carriage position and the information regarding the ID of each ink cartridge, by alternately repeating the process of moving the carriage which is holding the ink containers and the process of communication with one of the multiple ink cartridges. Further, it is undesirable to move the carriage during an ink cartridge replacement operation, in order to determine the ink cartridge order. Therefore, the operation for determining the ink cartridge order is carried out after a user closes the cover of the main assembly of an ink jet recording apparatus after the user finishes replacing the ink cartridges. Thus, the ink jet recording apparatus design disclosed in Japanese Laid-open Patent Application 2004-338394 is problematic in that this design makes it impossible to determine the ink cartridge order and the correctness (or mistake) in the positioning of the ink cartridges, in a short time immediately after the mounting of the ink cartridges.

Also in the case of the design disclosed in Japanese Laid-open Patent Application 2003-159808, in order to accurately detect the ink cartridge order, a wireless communication system which is relatively short in data transmission-reception range is employed. However, the range of a wireless communication system is rough estimate based on the probability with which communication is successfully made, and is affected by external factors, such as ink properties. Thus, even if the carriage is precisely moved into a preset position which theoretically enables the control portion to communicate with the ink cartridges on the carriage, there is no guarantee that this carriage position enables the control portion to satisfactorily communicate with the ink cartridge which is presumed to be able to communicate with the control portion when the carriage is in the preset position.

SUMMARY OF THE INVENTION

The present invention was made in consideration of the problems described above, and its primary object is to provide a recording apparatus which is capable of detecting the presence (absence) of recording liquid in a recording liquid container. Another object of the present invention is to provide a method for detecting the presence (absence) of recording liquid in a recording liquid container.

Another object of the present invention is to provide a wireless communication system, which is designed for the communication between the main assembly of a printer and the ink cartridges in the main assembly, and which makes it possible to accurately determine whether or not the ink cartridges in the main assembly are correct in position, immediately after the mounting of the ink cartridges into the main assembly.

According to an aspect of the present invention, there is provided a recording apparatus to which a recording liquid accommodating container having a recording liquid accommodating portion is mountable, wherein said recording liquid accommodating container includes communicating means for bi-directional wireless communication with said recording apparatus; said recording apparatus includes a communication antenna for wireless communication with said communicating means; said communication antenna and said communicating means are adapted to be disposed opposed to each other with said recording liquid accommodating portion interposed therebetween; and it is discriminated depending on a state of wireless communication between said communication antenna and said communicating means whether or not a remaining amount of the recording liquid in said recording liquid accommodating portion is not more than a predetermined amount.

According to another aspect of the present invention, there is provided a recording liquid remaining amount discrimination method comprising a sending step of wirelessly sending a signal across a recording liquid accommodating portion of a recording liquid accommodating container mounted to a recording apparatus to communicating means of a recording liquid accommodating portion; a receiving step of discriminating presence or absence of a reply signal from said communicating means in response to the wirelessly sent signal; and a determining step of determining on the basis of the discrimination of said receiving step whether or not a remaining amount of recording liquid in said recording liquid accommodating portion is not more than a predetermined amount.

According to a further aspect of the present invention, there is provided a cartridge comprising a memory medium capable of storing individuality information; a plurality of electrodes functioning as an electrical contact; detecting means for detecting a state of a potential of each of said electrodes; and a communication module for wireless communicating information relating to the individuality information and to the state of the potential.

According to a further aspect of the present invention, there is provided a recording apparatus comprising means for ejecting ink, onto a recording material, supplied from a cartridge as defined above, a cartridge holder including a connecting member for establishing conduction of the electrode at each of the plural mounting positions such that states of potentials of the electrodes are different depending on the mounting position when said cartridge is mounted in said cartridge holder; a communicating unit for wireless communication with said communication module; and information storing means for storing information for discriminating the mounting position of said cartridge on the basis of information received by said communicating unit.

Not only does the ink jet recording apparatus design described above make it possible for the main assembly of an ink jet recording apparatus to exchange desired information with the ink cartridges in the main assembly, with no delay, but also, to precisely detect the presence (absence) of ink in each of the ink cartridges in the main assembly, simply by switching the communication antennas.

Further, according to the present invention, it is possible to accurately determine whether or not the ink cartridges in the main assembly of a printer are correct in position, and inform a user thereof, immediately after the mounting of the ink cartridges into the main assembly.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENT

The present invention is preferably applicable to an ink jet printing apparatus which employs ink as recording agent to be applied to recording medium, a printing system inclusive of an ink jet printing apparatus, a recording liquid container in which ink as recording agent is stored. Hereinafter, the preferred embodiments of the present invention will be described with reference to the appended drawings.

Embodiment 1

Figure 1:
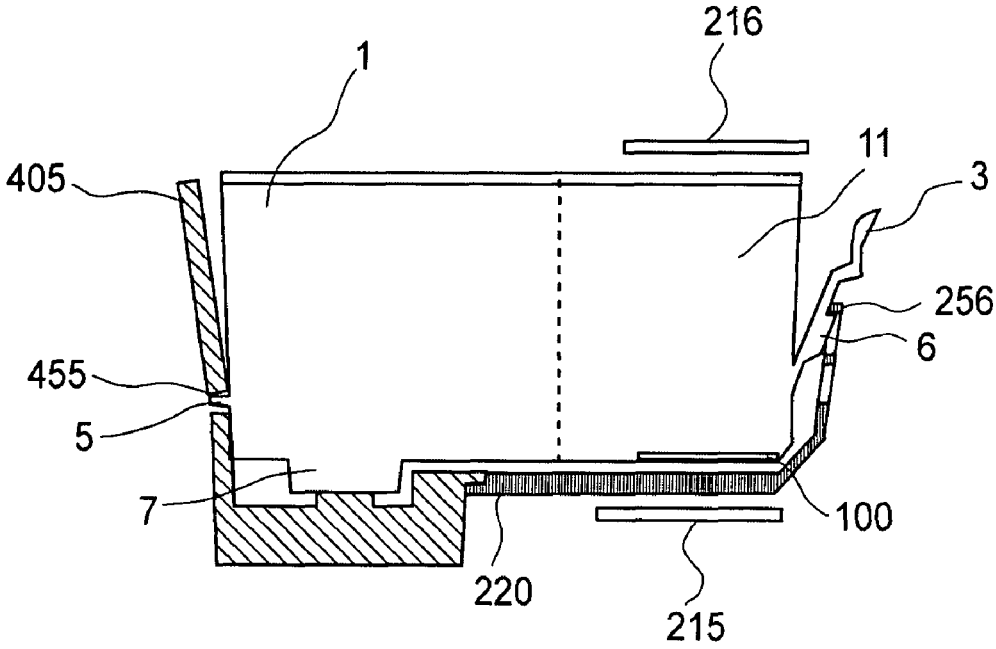
FIG. 1 is a sectional view of the recording liquid container for the ink jet recording apparatus in the first embodiment of the present invention, at a plane parallel to the lateral walls of the container.
Figure 5:
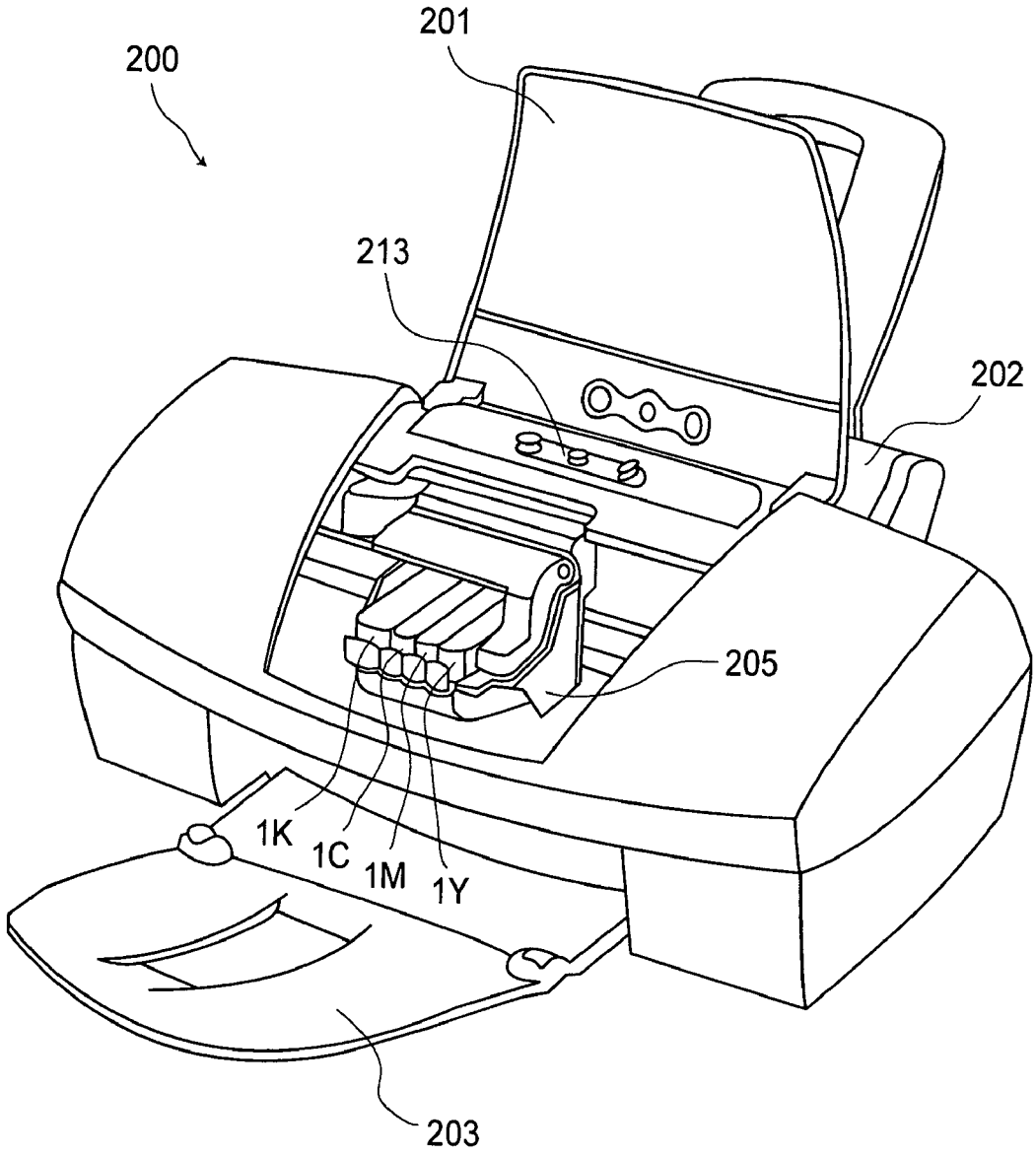
FIG. 5 is a perspective view of a typical ink jet recording apparatus.

FIG. 1 is a sectional view of the recording liquid container for the ink jet recording apparatus in the first embodiment of the present invention, at a plane parallel to the lateral walls of the container. This drawing shows a recording head unit 405 and a recording liquid container 1, which are in their proper positions on a carriage 205 (FIG. 5). The recording liquid container 1 is removably mountable in the ink jet recording apparatus. Although not shown in this drawing, the main assembly of the recording apparatus holds multiple recording liquid containers 1, which are different in the color of the ink they store, and which are juxtaposed in the direction perpendicular to the drawing. Each recording liquid container 1 has a first engaging portion 5 and a second engaging portion 6. The first engaging portion 5 engages with a first engaging portion 455 with which a recording head unit 405 is provided, and the second engaging portion 6 engages with a second engaging portion 456 with which the recording liquid container holder 220 is provided. With the engagement between the first and second engaging portions 5 and 6 of the recording liquid container 1 with the first and second engaging portions 455 and 220, respectively, the recording liquid container 1 is firmly held to the head unit 405 and recording liquid container holder 220. A latch lever 3 is formed of resin, and is an integral part of the recording liquid container 1. It is rotatable about the point at which it is attached to the recording liquid container 1. Thus, the latch lever 3 can be rotated when mounting the recording liquid container 1 into the recording liquid container holder, or carrying out the like operations. In this embodiment, the second engaging portion 6 is an integral part of the latch lever 3.

The carriage 205 can be kept stationary in a preselected wireless communication position. When the carriage 205 is in the wireless communication position, the recording liquid container 1 is between first and second communication antennas 216 (communication antenna) and 215 (information exchange antenna) with which the recording apparatus is provided. The first communication antenna 216 is solidly fixed to the main assembly of the recording apparatus with the use of a fastening member (unshown), whereas the first communication antenna 215 is solidly fixed to the carriage 205 by another fastening member (unshown). The recording liquid container 1 is provided with a communication module 100, which is attached to the bottom wall of the recording liquid container 1. The communication module 100 is located near the joint between the base portion of the latch lever 3 and the main structure of the recording liquid container 1. The communication module 100 enables the main assembly of the recording apparatus and the recording liquid container 1 to make two-way wireless communication between them through the first and second communication antennas 216 and 215. The first and second communication antennas 216 and 215, and the communication module 100 are positioned so that when the recording liquid container 1 is in the proper position in the apparatus main assembly, the recording liquid container proper 11 of the recording liquid container 1 will be between the first and second communication antennas 216 and 215. The second communication antenna 215 is positioned so that when the recording liquid container 1 is in the proper position in the apparatus main assembly, the second communication antenna 215 and the communication module 100 of the recording liquid container 1 are on the same side of the recording liquid container proper 11, being in the adjacencies of the communication module 100, that is, so that the recording liquid container proper 11 is not between the second communication antenna 215 and the communication module 100.

When the recording liquid container 1 is in the proper position in the apparatus main assembly, the first communication antenna 216 is directly above the second communication unit 215. The first and second communication antennas 216 and 215 are in connection with the wireless communication unit 304 with which a control circuit 300 (FIG. 6) of the recording apparatus main assembly. The wireless communication unit 304 is provided with an antenna switching device 305, which makes a switch between the first and second communication antennas 216 and 215 as necessary, to allow the wireless communication unit 304 to communicate with the communication module 100 of the recording liquid container 1 through the first communication antenna 216 or second communication antenna 215. The communication method is based on electromagnetic induction, and uses a radio wave which is 13.56 MHz in frequency.

The width of the first communication antenna 216 in terms of the direction in which the multiple recording liquid containers 1 are juxtaposed is roughly equal to, or smaller than, the width of the bottom wall of the recording liquid container 1 which is provided with communication module 100, in terms of the direction (perpendicular to drawing) in which the multiple recording liquid containers 1 are juxtaposed. Therefore, the portion of the magnetic field which the first communication antenna 216 generates, and which reaches the communication module 100, as the communicational target, of each of the multiple recording liquid containers 1, does not go through the other recording liquid containers 1. Thus, even in the case of an ink jet recording apparatus in which multiple recording liquid containers 1 are juxtaposed, it does not occur that the communication between the main assembly of the recording apparatus and targeted recording liquid containers 1 is affected by the other recording liquid containers 1.

Figure 2:
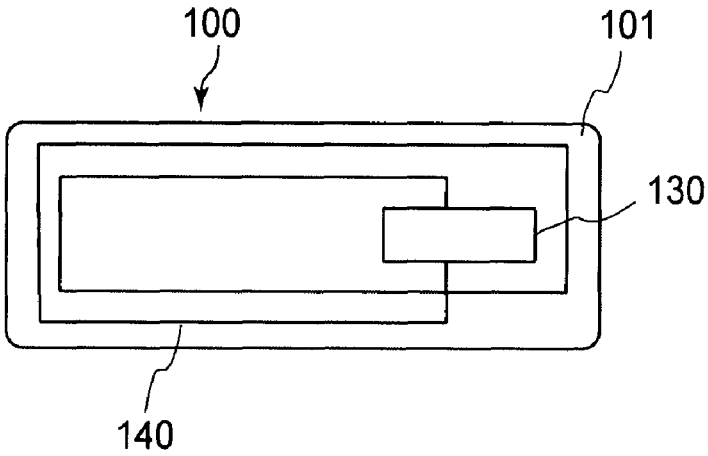
FIG. 2 is a schematic plan view of the communication module of the recording liquid container, showing the general structure thereof.

FIG. 2 is a schematic plan view of the communication module 100 with which the recording liquid container 1 is provided, and shows the structure of the module 100. The communication module 100 is made up of: a base sheet 101, a circuit chip 130, an antenna 140 formed of copper foil, aluminum foil, or the like material. The circuit chip 130 and antenna 140 are attached to the base sheet 101, and are laminated with a cover sheet. The base sheet 101 is formed of film of PET (polyethyleneterephthalate) or PEN (polyethylenenaphthalate), or the like.

Figure 3:
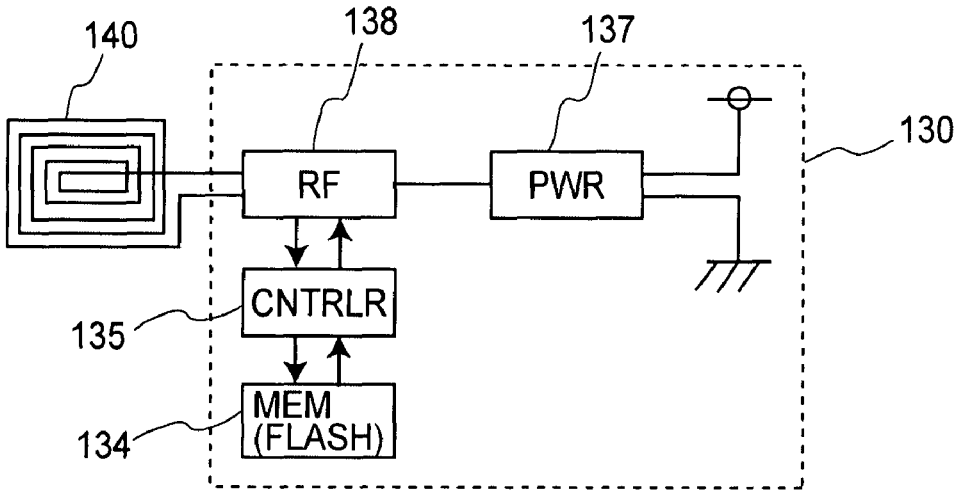
FIG. 3 is a block diagram of the circuit chip, showing the structure thereof.

Referring to FIG. 3, the circuit chip 130 has an RF circuit 138 connected to an antenna 140, an electric power circuit 137, a control circuit 135, a storage circuit 134 as information storage medium which is a flash memory or the like. The storage circuit 134 is indirectly in connection with the electric power circuit 137 through the control circuit and RF circuit 138.

The RF circuit 138 is a circuit which detects the AC signals which are electromagnetically induced in the antenna 140, and inputs the AC signals into the circuit chip 130. Then, it outputs the power component extracted from the AC signals into the power circuit 137, and the signal components extracted from the AC signals into the control circuit 135. The RF circuit 138 also has the function of receiving signals from the control circuit 135, changing the signals into AC signals by modulation, and then, transmitting the AC signals to the recording apparatus main assembly, through the antenna 140. The antenna 140, RF circuit 138, and power circuit 137 electromagnetically generate electric power, and the control circuit 135 transmits or receives preselected information, over radio wave, using the electric power supplied by the power circuit 137. The control circuit 135 also controls the internal operations, such as reading the information in the storage circuit 134, or writing the information into the storage circuit 134. The storage circuit 134 stores information, such as classification (including type recording apparatus with which recording liquid container is compatible), unique identity, production date, expiration date of the recording liquid container, and the amount of ink remaining in the recording liquid container, etc. (unshown).

Figure 4:
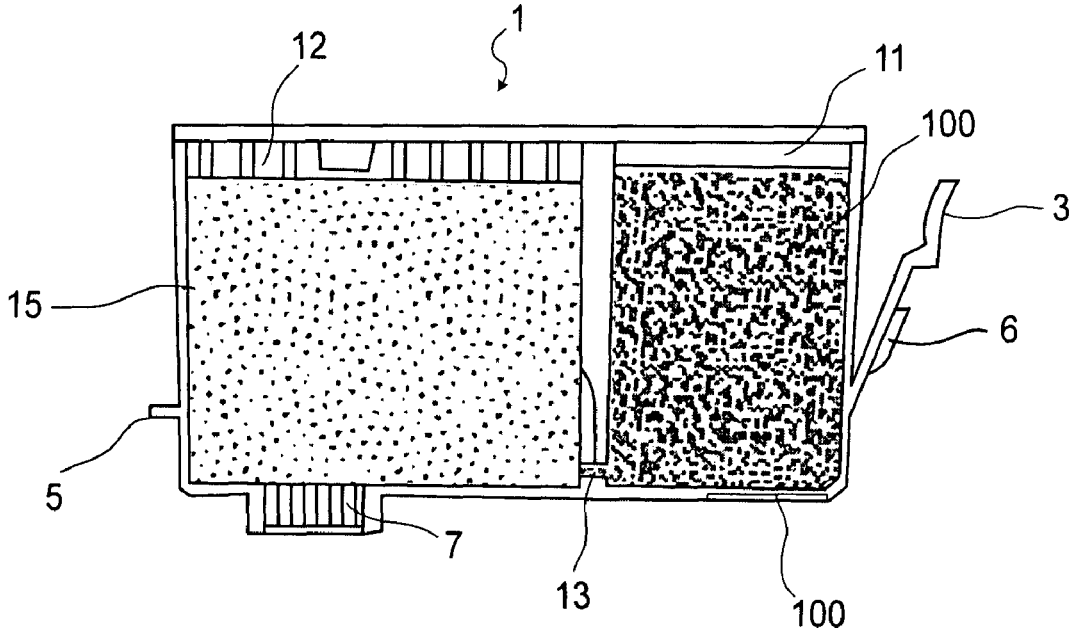
FIG. 4 is a sectional view of the recording liquid container, at a plane parallel to the lateral walls of the container.

FIG. 4 is a sectional view of the recording liquid container, at a plane parallel to the lateral walls of the recording liquid container. The recording liquid container 1 has a recording liquid chamber 11 and a negative pressure generating member chamber 12. The two chambers 11 and 12 are in connection with each other through a hole 13. The negative pressure generating member chamber 12 is connected to an ink outlet 7. The first and second communication antennas 216 and 215 are positioned so that when the recording liquid container 1 is in the proper position on the carriage 205, the first and second communication antennas 216 and 215 are directly above and below, respectively, the recording liquid chamber 11. The recording liquid container 11 directly stores ink 10, whereas the negative pressure generating member chamber 12 is filled with an ink absorbing member 15, which is formed of sponge, bundled fibrous substance, or the like, which absorbs and retains ink. The ink absorbing member 15 generates such an amount of negative pressure that is sufficient to prevent ink from leaking through ink jetting nozzles, in coordination with the ink retaining force which is provided by the meniscus formed in the opening of each ink jetting nozzle, and yet, is small enough to allow the recording head to jet ink. The ink 10 in the recording liquid chamber 11 is supplied to the recording head through the negative pressure generating member chamber 12 and ink outlet 7.

The internal structure of the recording liquid container 1 does not need to be limited to the above described one; the internal space of the recording liquid container 1 is divided into an ink absorbing member chamber, and an ink chamber in which ink is directly stored. For example, practically the entirety of the internal space of the recording liquid container 1 may be filled with an ink absorbing member. Further, instead of an ink absorbing member, an ink pouch formed of elastic substance, such as rubber, may be employed as the negative pressure generating means. In the case of the ink pouch, the ink pouch is constructed so that the elasticity (resiliency) of its material acts in the direction to expand the pouch, that is, in the direction to generate negative pressure in the pouch, and ink is directly stored in the pouch. Further, the negative pressure may be generated by forming the wall (at least part of wall) of the ink chamber, of flexible substance, and applying outward pressure to the wall (part of wall) with the use of a spring or the like. Also in this case, ink is directly stored in the ink chamber.

FIG. 5 is a perspective view of the ink jet recording apparatus, in this embodiment, the main cover of which is open. The recording apparatus 200 has: a recording head; four recording liquid containers, more specifically, black, cyan, magenta, and yellow (which hereafter may be abbreviated as K, C, M, and Y, respectively) recording liquid containers 1K, 1C, 1M, and 1Y; and the carriage 205 on which the four recording liquid containers are mounted. The essential portions of the recording apparatus, such as the mechanism which moves the carriage 205 in a manner to scan recording medium to record an image, are covered with the main assembly cover 201 and the other parts of the external shell of the recording apparatus.

The front portion of the main assembly of the recording apparatus 200 is provided with a paper discharging unit (unshown) provided with a pair of paper discharge rollers, and a paper delivery tray 203 which is on the immediately downstream side of the paper discharge rollers, in terms of the recording medium conveyance direction. The rear portion of the recording apparatus main assembly is provided with an automatic paper feeding apparatus (ASF) 202. Further, the recording apparatus 200 is provided with a control panel 213, which is provided with a display, a power source switch, and a reset switch, which are usable when the main assembly cover is open, as well as closed.

Figure 6:
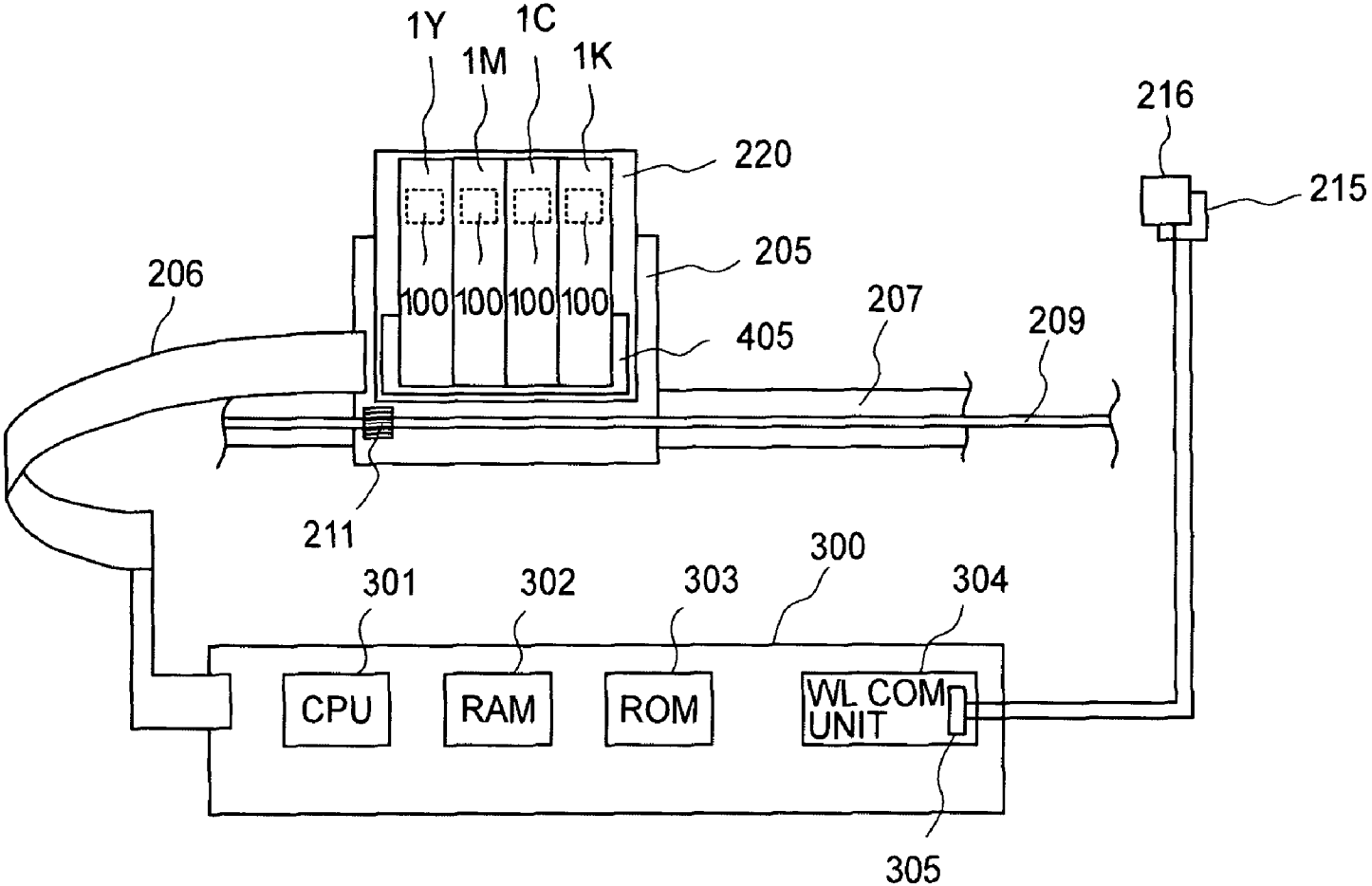
FIG. 6 is a block diagram of the ink jet recording apparatus, showing the structure of the control system of the apparatus.

FIG. 6 is a block diagram of the control portion of the ink jet recording apparatus described above, and shows the structure of the control portion. FIG. 6 primarily shows the control circuit 300 of the recording apparatus main assembly, which is in the form of a PCB (printed circuit board), and the essential elements controlled by the control circuit 300.

The control circuit 300 controls the data processing operation and actual printing operation of this recording apparatus. More specifically, the control circuit 300 has a CPU (Central Processing Unit) 301, a ROM (Read Only Memory) 303, and a RAM (Random Access Memory) 302. The CPU 301 controls the processes related to the printing operation of the recording apparatus, based on the programs stored in the ROM 303. The RAM 302 is used as a work area by the CPU 301 when the CPU carries out the printing operation.

As described schematically in FIG. 6, the recording head unit 405 on the carriage 205 has multiple (four, in this embodiment) recording heads (unshown), each of which has multiple nozzles for jetting ink (K, C, M, or Y ink). The recording liquid containers 1K, 1C, 1M, and 1Y are removably mounted in the recording liquid container holder 220 so that they correspond in position to the recording heads, one for one, of the recording head unit 405.

The connector (unshown) with which the carriage 205 is provided is in connection with the control circuit 300 on the main assembly side, through a flexible cable 206 so that signals can be exchanged between the recording heads in the recording head unit 405, and the control circuit 300. That is, as the recording head unit 405 is mounted on the carriage 205, the connector of the carriage 205 becomes connected with the connector of the recording head unit 405, allowing thereby signals to be exchanged between the carriage 205 and recording head unit 405, and also, the driving circuit with which the recording head is provided becomes connected to the control circuit 300 of the main assembly, through the connector of the recording head unit 405, connector of the carriage 205, and flexible cable 206, allowing thereby signals to be exchanged between the driving circuit and control circuit 300. In other words, as the recording head unit 405 is mounted on the carriage 205, it becomes possible for the control circuit 300 to control the recording heads in the ink jetting operation, or the like.

The recording apparatus main assembly is provided with an encoder scale 209, which extends along the moving path of the carriage 205. The carriage 205 is provided with an encoder sensor 211. The signals outputted from this sensor are inputted into the control circuit 300 through the flexible cable 206, and are used by the control circuit 300 to determine the position of the carriage 205. This information regarding the carriage position is used to control the ink jetting operations of the recording heads.

The recording operation of the recording apparatus in this embodiment is as follows: Inks different in color are supplied to the recording head unit 405. The recording head unit 405 is moved by the movement of the carriage 205, in a manner to scan the recording medium, such as a sheet of recording paper. While the recording head unit 405 is moved in the abovementioned manner, the inks are jetted from the recording heads onto the recording medium to form an image on the recording medium. That is, the apparatus main assembly is provided with a guiding shaft 207, which extends in the direction perpendicular to the recording medium conveyance direction. The carriage 205 is in engagement with the guiding shaft 207, being enabled to slide on the guiding shaft 207 by being driven by a carriage motor and a carriage driving force transmitting mechanism. The recording heads, which correspond to K, C, M, and Y inks, one for one, jet corresponding inks, in response to the signals sent from the control circuit 300, through the flexible cable 206, based on the image formation data.

The recording apparatus main assembly is also provided with a paper conveying mechanism, such as paper conveyance rollers, paper discharging rollers, etc. Thus, as a sheet of recording medium (unshown) is fed into the main assembly from the automatic paper feeding apparatus 202, the sheet of recording paper can be conveyed to the delivery tray 203. While the recording head is moved in a manner to scan the recording medium, the recording head jets ink onto the recording medium. As a result, a part of an intended image, the width of which in terms of the recording medium conveyance direction matches the length of each row of the openings of the ink jetting nozzles, is formed on the recording medium. Between this movement which the recording head (carriage) makes in a manner to scan the recording medium, and the next movement which the recording head (carriage) makes in a manner to scan the recording medium, the recording medium is conveyed by a preset distance which is equal to the abovementioned width by which a part of the intended image is formed. This operation of recording a part of the intended image and conveying the recording medium by the preset distance is repeated to incrementally form the intended image.

As described above, the main assembly of the ink jet recording apparatus is provided with the first and second communication antennas 216 and 215 for wirelessly communicating with the communication module 100 with which each of the recording liquid containers is provided. The locations of the communication antennas 216 and 215 are preset within the moving range of the carriage 205. The first and second communication antennas 216 and 215 are in connection with an antenna switching device 305, which is a part of the wireless communication unit 304, which is a part of the control circuit 300. The amount of the output power of the wireless communication unit 304 is within a preset range, and is adjustable; it is adjusted in advance to the minimum value at which the communication unit 304 can communicate with the communication module 100 of each recording liquid container, when the recording liquid container does not have ink. Ink absorbs radio wave. Thus, if radio wave is sent out when the recording liquid container has ink, the radio wave is absorbed by the ink in the container, and therefore, attenuates as the radio wave passes the container, resulting in communication errors. Therefore, the presence (absence) of the ink in the recording liquid container can be determined based on the communication error occurrence probability.

Figure 7:
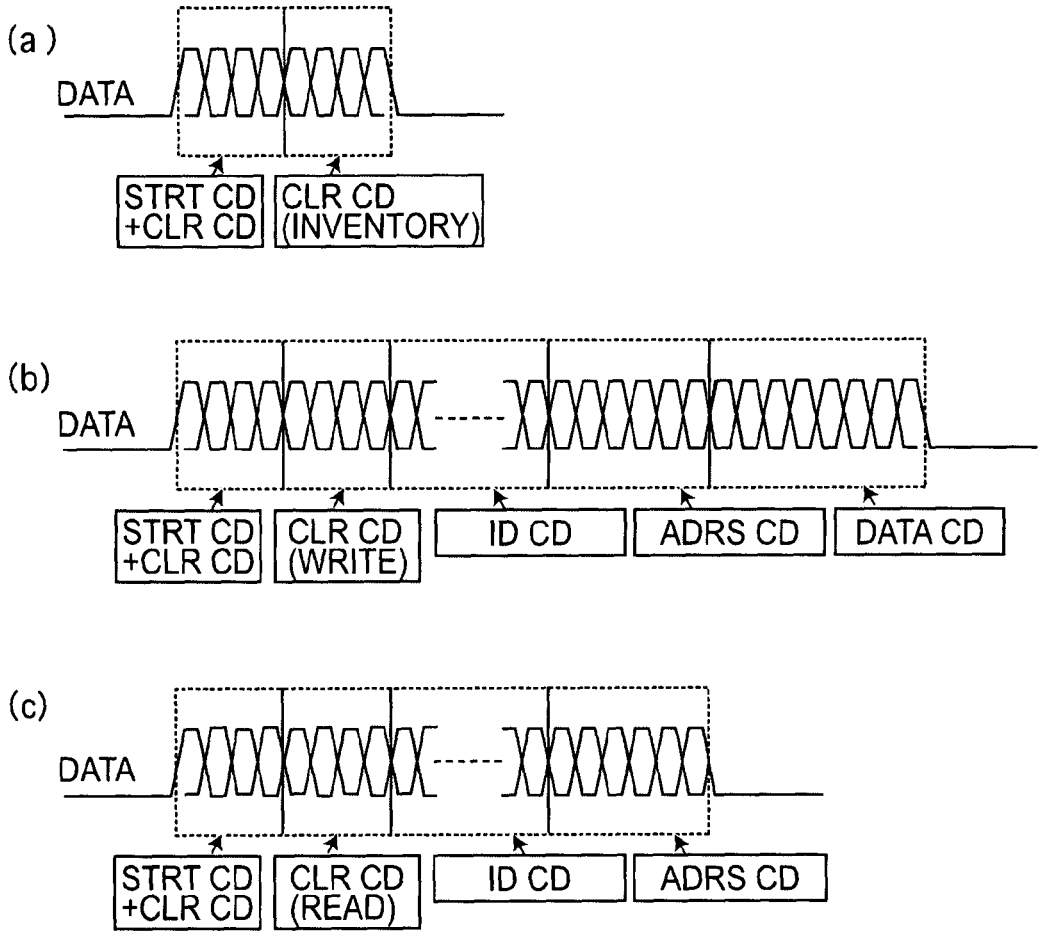
FIG. 7 is a schematic drawing showing the structure of the data carried by the command transmitted by the communication unit of the main assembly to access the IC module of a specific ink cartridge in the main assembly.

FIG. 7 is a schematic drawing which shows the structure of the data which the wireless communication unit 304 transmits to access the communication module of a specific recording liquid container 1. FIG. 7(*a*) shows an example of the structure of the signal sequence of the data for reading the unique identification of a recording liquid container. The wireless communication unit 304 transmits a block of data signals which make up "start code+color code" and "control code", to the communication module 100. The "start code" portion of "start code+color code" indicates the starting point of the data signal sequence, whereas the "color code" portion specifies the ink type of the recording liquid container which the wireless communication unit 304 is to access. Here, "color" means not only each of various colors such as Y, M, C, etc., but also, various degrees of density of each color ink.

There are four "color codes" which correspond to the ink colors K, C, M, and Y. The control circuit 135 compares the color information which the color code indicates, with the color information in the storage circuit 134. The control circuit 135 continues the process of accessing the data signals only if the two pieces of color information match. If the two pieces of information do not match, the control circuit 135 carries out the process for ignoring the data signals which come in thereafter. With this arrangement, that is, with the abovementioned color information included in the data signals, even though the data signals are sent to all the recording liquid containers, it is possible to target the recording liquid container which contains the ink of a specific color, and process, thereafter, only the data related to the container containing the ink of the specific color. In an operation for reading the ID which is unique to each recording liquid container, the "start code+color code" portion of the data signal sequence are read by communication modules of all the recording liquid containers, and "INVENTORY" portion is read only by the control circuit 135 (FIG. 3) of the recording liquid container whose color code matches the color code portion of the "start code+color code" transmitted by the wireless communication unit 304. The control circuit 135 which read the "INVENTORY" portion replies by transmitting the unique identification data (which hereafter will be referred to as UID) stored in the storage circuit 134.

FIG. 7(*b*) is an example of the structure of the data signal sequence written in the storage circuit 134. The wireless communication unit 304 transmits the signal sequence made up of the "start code", "UID code", "address code", and "data code" to the communication module 100.

In a writing operation, the commands is read by the communication modules 100 of all the recording liquid containers, and the control circuit 135 of only the recording liquid container whose color code matches the color code portion of the "start code+color code" transmitted by the wireless communication unit 304 accepts "WRITE" code and thereafter in the signal sequence. Further, the "WRITE" code is constructed as a command that includes a UID (unique identification data). The control circuit 135 of only the recording liquid container whose UID code matches the UID portion of the signal sequence transmitted by the wireless communication unit 304 continues the subsequent processes. The next portion of the signal sequence, that is, "address" code, indicates the address of the portion of the memory array, into which data are to be written. The last portion of the signal sequence, that is, data code portion is the actual data to be written.

It is needless to say that the contents which the "control" indicates do not need to be limited to those mentioned above. For example, the "control" code may include such control commands as continuous write command, "verification command". Further, a write command which does not have a "UID" code (for example, WRITE-ALL command (unshown)) which can be written in all the accessible communication modules may be provided separately from the write command described above.

FIG. 7(*c*) shows an example of the structure of the data code sequence in the storage circuit 134. The structure of the data code sequence is the same as the structure of the date code sequence written in the above described operation of writing the data. The control circuit 135 of only the recording liquid container whose "color code" portion and "UID code" portion match the counterparts in the code sequence transmitted by the wireless communication unit 304 carries out the internal processes in response to the "READ" code. That is, the data in the portion of the memory array, which is designated by "address" code are read, and the signals resulting from the reading operation are transmitted to the wireless communication unit 304.

Next, the preset steps in the process for determining the amount of recording liquid remainder, that is, the preset steps in the process for detecting the presence (or absence) of ink in the recording liquid container, which are carried out when the main assembly of the recording apparatus in this embodiment is idling, will be concretely described.

The wireless communication unit 304 switches the antenna to the first communication antenna 216, that is, the antenna for detecting the presence (or absence) of ink. Then, the carriage 205 is moved into the position which enables the wireless communication unit 304 to communicate with the first of the four different recording liquid containers. Then, while this first recording liquid container is in this position, in which the recording liquid container proper of the recording liquid container is between the first communication antenna 216 and the communication module 100, the wireless communication unit 304 of the recording apparatus main assembly transmits radio signals in the vertical direction, that is, toward the communicating means (communication module 100) of the recording liquid container proper of this first recording liquid container in the recording apparatus. During this process, the wireless communication unit 304 transmits two or more times a dummy radio signal while keeping the signal strength at the same level. Then, the wireless communication unit 304 counts the number of times (number of successful reply) the communication module 100 transmits a reply signal in response to the dummy signal transmitted the preset number of times by the wireless communication unit 304. The number of times the communication module 100 transmitted the reply signal is obtained by counting the number of the reply signals which are received through the first or second communication antennas 216 or 215. If the number of times the reply signal was received (ratio of number of times reply signal is received, relative to number of times dummy signal is transmitted) is smaller than a preset threshold value, the control portion determines that there is a sufficient amount of ink in the recording liquid container, and if it is larger than the preset threshold value, the control portion determines that there is no ink in the recording liquid container, or the amount of ink in the recording liquid container is less than a preset amount. Or, if the ratio of the number of times the reply signal is transmitted, relative to the number of times the wireless communication unit 304 sent through the first communication antenna 216, is greater than a preset threshold value, the control portion determines that the amount of recording liquid in the recording liquid container fell below a preset amount. Next, the carriage is moved into the position, which corresponds to the position of the second recording liquid container. Then, the same process as the one described above is carried out to allow the control portion to determine the amount of ink in the second recording liquid container. Then, the same process carried out for the rest of the recording liquid containers. The dummy command is used only for determining whether or not communication is possible between the wireless communication unit 304 and the communication module 100 of each recording liquid container. Therefore, the dummy command may be in any form, as long as it includes preselected data to be transmitted in the reply transmitted by the communication module 100.

In order to ensure that it is accurately detected when any of the recording liquid containers has run out of ink as the ink in the recording liquid container is consumed, the following method may be employed: The number of times it was determined that a specific recording liquid container did not have ink (presence of reply) is counted, and only when it is consecutively determined more than a preset number of times that the recording liquid container did not have ink, it is determined that the recording liquid container has run out of ink.

As another method which may be employed to determine whether or not a recording liquid container has ink, there is a method which uses the level of the signal, at which successful communication is possible. That is, the output signal is incrementally increased in signal level (signal strength) from the level at which communication is impossible even if there is no ink in a recording liquid container, and if the level at which communication becomes possible for the first time is greater than a preset threshold value, it is determined that there is ink, and if it is smaller than the preset threshold value, it is determined that there is no ink or the amount of ink in the recording liquid container is less than a preset amount.

If the wireless communication modules, with which the recording liquid containers are provided, one for one, are different in the radio wave detection performance, the following method may be employed: The recording liquid containers are ranked in the radio wave detection performance, and the ranking may be stored in the storage chip of each wireless communication module. The recording medium main assembly reads this ranking, and adjusts in strength the radio wave which its wireless communication unit 304 transmits to increase the accuracy with which the presence or absence of ink can be detected.

As described above, the absorbency of radio wave by water is affected by the frequency of radio wave. However, the radio wave, the frequency of which is in the microwave range is highest in the absorbency by water. Thus, the accuracy with which the presence or absence of ink is detected can be improved by adjusting the shape and size of the antenna, and the strength of the radio wave output.

This method for detecting the presence or absence of ink may be used in conjunction with the method described prior to this method, that is, the method which counts the number of ink droplets to detect the presence or absence of ink, more specifically, the method which manages the amount of the ink remaining in each recording liquid container by storing the amount of the ink remainder in the recording liquid container, which is estimated by conversion, in the storage circuit 134 of the recording liquid container, through the second communication antenna 215, and informs a user of the account of ink consumption. With the conjunctive use of these two methods, it is possible to automatically stop the on-going printing, give a user a warning, and prompt the user to carry out a proper procedure, such as replacing the recording liquid container, at the point in time when it is ultimately determined through the first communication antenna 216 that there is no ink.

In this embodiment, information of the preselected type is renewably stored in the storage circuit 134 of each recording liquid container 1, and the main assembly of the recording apparatus 200 reads the information of the preselected type in the storage circuit 134 of the recording liquid container 1, and writes new information of the preselected type into the storage circuit 134 of the recording liquid container 1. However, the information storage medium of the storage circuit 134 may be replaced with a ROM, that is, an information storage medium which is not rewritable, so that the wireless communication unit 304 of the main assembly of the recording apparatus 200 is allowed only to read the information of the preselected type in the information storage means of the recording liquid container.

Also in this embodiment, a flash memory is used as the information storage medium for the recording liquid container 1. However, it may be replaced with another element, for example, a RAM which is in connection with a battery, a ROM, an EEROM (Electrically Erasable Programmable ROM), a FeROM (Ferroelectric RAM), etc.

Also in this embodiment, the recording liquid container 1 is provided with an electric power generating means, which is made up of the antenna 140, RF circuit 138, and electric power circuit 137, and generates electric power by electromagnetic induction. However, the electric power may be generated by utilizing the electric field energy of microwave, or the communication module may be provided with a battery.

Embodiment 2

Figure 8:
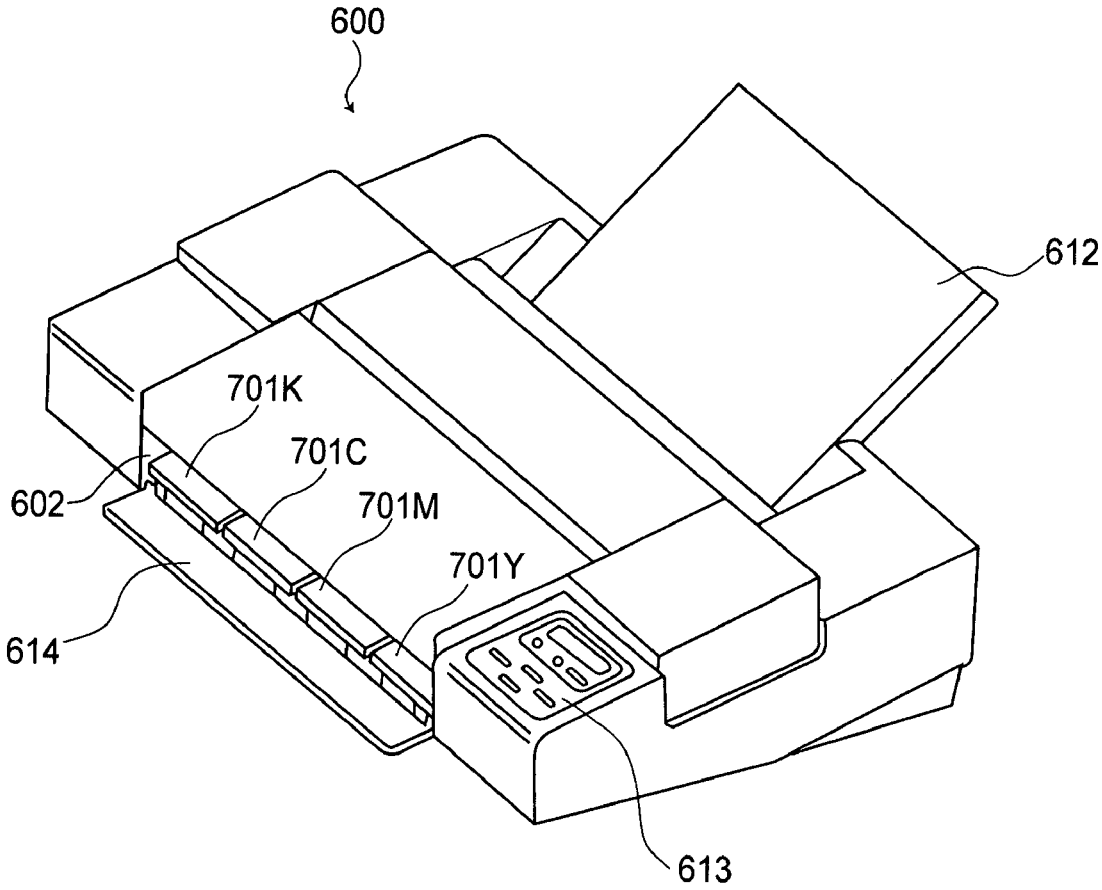
FIG. 8 is a perspective view of the ink jet recording apparatus in the second embodiment of the present invention.

FIG. 8 is a perspective view of the ink jet recording apparatus in the second embodiment of the present invention, the recording liquid container chamber 602 of which is in the bottom portion of its main assembly. In FIG. 8, the cover 614 of the recording liquid container chamber 602 is open, and therefore, the recording liquid container chamber 602 is exposed. There are recording liquid containers 701K, 701C, 701M, and 701Y in the recording liquid container chamber 602. As each recording liquid container 701 is mounted into the recording liquid container chamber 601, it becomes connected to an ink supply tube (unshown) or the like, making it possible for the ink in the recording liquid container 701 to be supplied to a recording head (unshown). The recording apparatus 600 is this embodiment is structured so that the recording liquid containers are directly anchored to the main assembly itself of the recording apparatus, instead of being mounted on a carriage. Thus, the carriage of the recording apparatus in this embodiment may be smaller in size than the one employed by the recording apparatus in the first embodiment, and so is the motor for driving the carriage, in terms of driving capacity.

Figure 9:
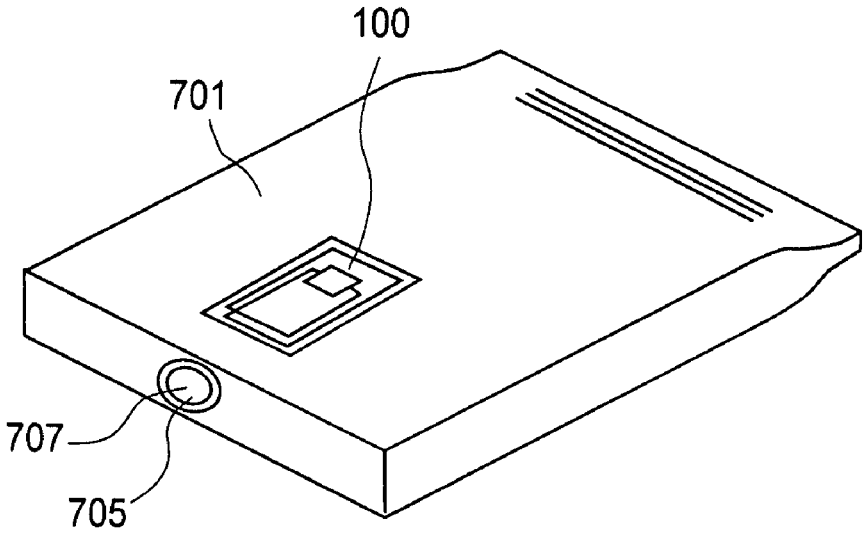
FIG. 9 is a schematic perspective view of the recording liquid container.

FIG. 9 is a schematic perspective view of one of the recording liquid containers 701 in this embodiment. The ink outlet 707 of this recording liquid container 701 is a part of one of the lateral walls of the container, and remains sealed with a flexible sealing member 705. The top wall of the recording liquid container 701, which is one of the walls of the recording liquid container 701, which are parallel to the direction in which the multiple recording liquid containers 701 are juxtaposed, is provided with the communication module 100.

Figure 10:
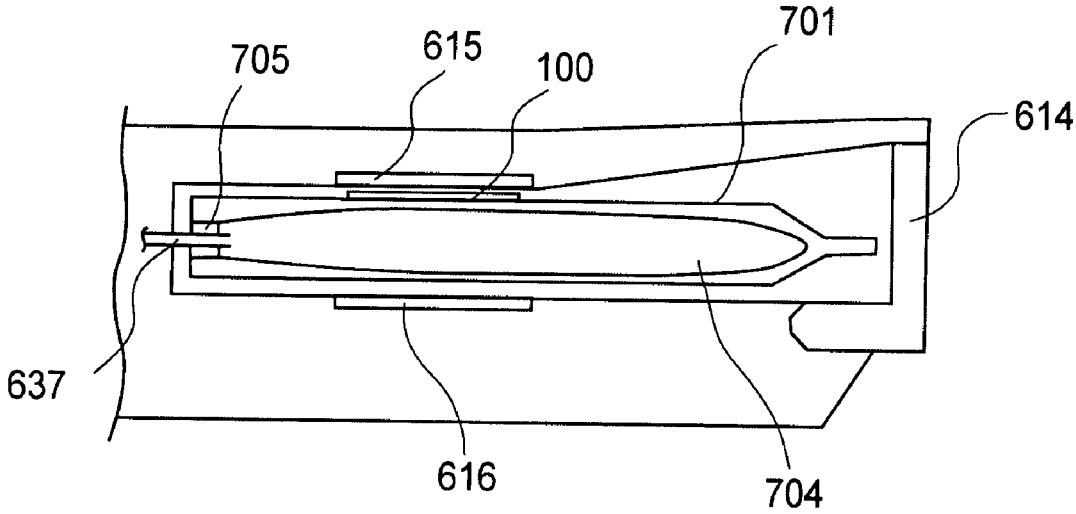
FIG. 10 is a sectional view of the recording liquid container in the main assembly of the ink jet recording apparatus, at a plane parallel to the lateral walls of the container, showing the state of the container in the main assembly.

FIG. 10 is a sectional view of one of the recording liquid containers 701, which are in the recording liquid container chamber 602, the cover of which is closed, at a plane parallel to the lateral walls of the recording liquid container 701. The recording liquid container 701 is provided with an ink pouch 704, which is in the hollow of the shell of the recording liquid container 701. The ink pouch 704 is formed of polypropylene film or the like. As the recording liquid container 701 is mounted into the recording liquid container chamber 602, the ink outlet 707 of the recording liquid container 701 couples with the needle-like ink drawing member 637 of the main assembly, making it possible for the ink in the recording liquid container 701 to be supplied to the recording head. The recording liquid container chamber 602 are provided with multiple first communication antennas 616 (one for each recording liquid container), which are positioned so that when the recording liquid containers are in the recording liquid container chamber 602, the first communication antennas 616 are directly below the corresponding recording liquid containers. That is, each first communication antenna 616 is attached to the wall of the recording liquid container chamber 602 of the recording apparatus main assembly so that when a recording liquid container 701 is in the recording liquid container chamber 602, the recording liquid container 701 is between the first communication antenna 616 and the communication module 100. Further, recording liquid container chamber 602 are provided with multiple second communication antennas 615 (one for each recording liquid container), which are positioned so that when the recording liquid containers are in the recording liquid container chamber 602, the second communication antennas 615 are directly above the corresponding recording liquid containers. Therefore, when a recording liquid container 701 is in the recording liquid container chamber 602, the corresponding second communication antenna 615 with which the recording apparatus main assembly is provided is next to the communication module 100 of this recording liquid container 701, making it possible for the second communication antenna 615 and communication module 100 to communicate with each other. As the ink in a recording liquid container 701 is consumed, the ink pouch gradually collapses in the vertical direction in the drawing. Thus, the presence or absence of ink in a given recording liquid container 701 can be detected by checking whether or not communication is possible between the communication module 100 of the recording liquid container and the corresponding second communication antenna 615, as it was possible in the first embodiment. As for the antenna switching by the wireless communication unit, any of the multiple first communication antennas 616 and multiple second communication antennas 615 can be selected.

In this embodiment, the recording liquid containers are anchored to a preselected area of the main assembly of the recording apparatus, instead of being mounted on the carriage. Thus, each recording liquid container must be provided with its own communication antenna. However, the apparatus main assembly requires only one wireless communication unit, and can communicate with each recording liquid container simply by switching antennas. Therefore, cost increase can be minimized.

Embodiment 3

Figure 11:
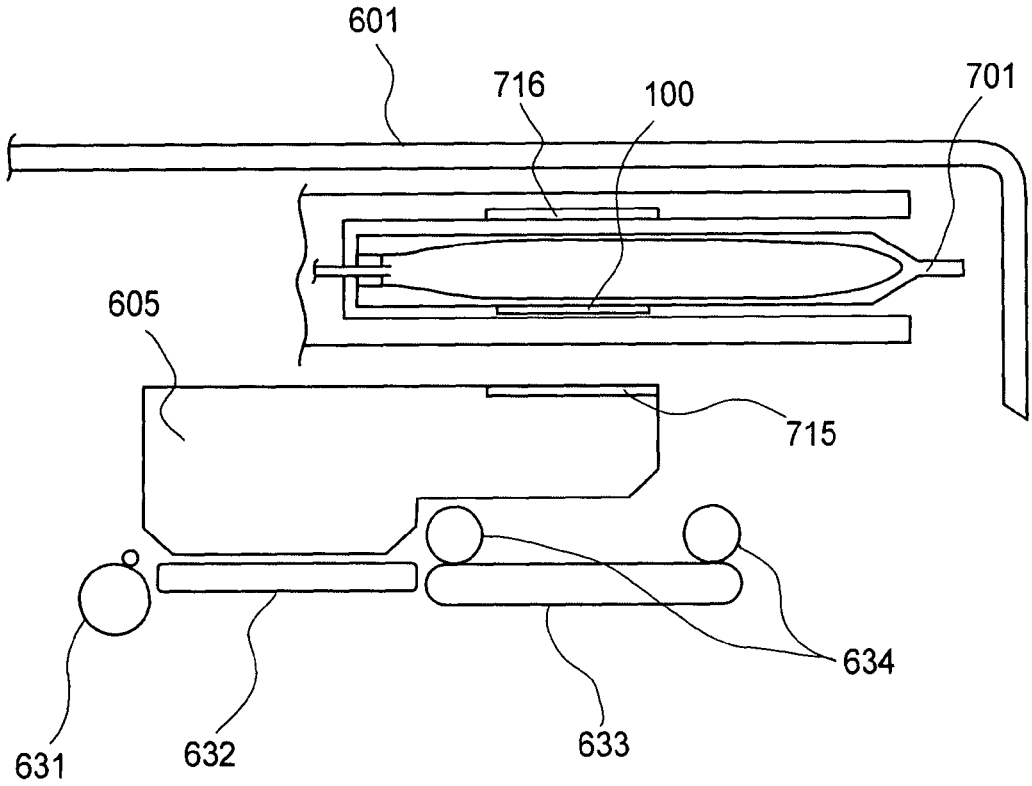
FIG. 11 is a sectional view of the essential portions of the ink jet recording apparatus in the third embodiment of the present invention, at a plane parallel to the lateral walls of the recording liquid container.

FIG. 11 is a sectional view of the essential portions, more specifically, the recording liquid container chamber, carriage, recording medium conveyance unit, etc., of the ink jet recording apparatus in the third embodiment of the present invention, at a plane parallel to the lateral walls of the recording liquid container. The carriage 605 includes a printing head, which is moved in a manner to scan recording medium in the direction perpendicular to the drawing, in order to print an image on the recording medium. The printing medium is fed into the main assembly of the recording medium by a paper feeding roller 631, and is discharged after being moved along a platen 632, a paper discharging roller unit 633, a spur 634, etc.

In this embodiment, the recording liquid container chamber of the recording apparatus is in the top front portion of the main assembly of the recording apparatus, and multiple recording liquid containers are juxtaposed in the recording liquid container chamber in the direction parallel to the moving direction of the carriage (direction perpendicular to drawing). The recording liquid container chamber is provided with multiple first communication antennas 716 (one for each recording liquid container), which are positioned so that when the recording liquid containers are in the recording liquid container chamber, the first communication antennas 716 are directly above the corresponding recording liquid containers. The second communication antenna 715 is supported by the carriage 605, being enabled to be moved by the carriage 605, to the area, in the adjacencies of the communication module 100 with which each recording liquid container 701 is provided, where wireless communication is possible between the second communication antenna 715 and the communication modules 100, that is, being enabled to move directly below each of the recording liquid containers 701. Therefore, the number of necessary second communication antenna 715 is only one; it is unnecessary to provide the main assembly of the recording apparatus with multiple second communication antennas 715 by the number which matches the number of the inks different in color. As for the antenna switching, all that is necessary is to select any of the multiple first communication antennas 716, or the second communication antenna 715.

In the first and second embodiments of the present invention described above, the ink in each recording liquid container was supplied to the corresponding recording head on the carriage, through the ink delivery tube or the like. However, an ink jet recording apparatus structured as those in the first and second embodiments were structured may be provided with a subordinate recording liquid containers, which are provided with a negative pressure generating mechanism, and which temporarily holds, by just enough amount, the ink to be immediately supplied to the recording head. Up to this point in this specification portion of the application of the present invention, it has been the replaceable recording liquid containers that have been primarily described. However, the application of the present invention does not need to be limited to recording liquid containers, such as those described above. For example, the present invention is also applicable to ink jet recording apparatuses, in which subordinate recording liquid containers are provided with the communication module. In such a case, the information, or the like, regarding the ink in the subordinate recording liquid container can be exchanged with the use of the second communication antenna 215, and the presence or absence of ink in the subordinate recording liquid container can be detected with the use of the first communication antenna 216.

The recording apparatuses in the first to third embodiments of the present invention described above were provided with the first communication antenna used for detecting the presence or absence of ink in each recording liquid container, and the second communication antenna used for exchanging the information regarding each recording liquid container, on the premise that communication is wirelessly made between the main assembly of the ink jet recording apparatus and recording liquid containers. Therefore, not only can the information of the preselected type be exchanged without delay, but also, the presence or absence of ink in each recording liquid container can be easily detected by simply switching the communication antennas. There is no specific requirement regarding the material for the recording liquid containers, except that the material for the recording liquid containers is required not to block radio wave. Further, the recording liquid containers do not require structural components for detecting the presence or absence of ink.

Embodiment 4

Next, the fourth embodiment of the present invention will be described.

The perspective view of the main assembly of the recording apparatus in this embodiment, and the block diagram of the control portion of the recording apparatus in this embodiment, are the same as FIGS. 5 and 6, respectively.

Figure 12:
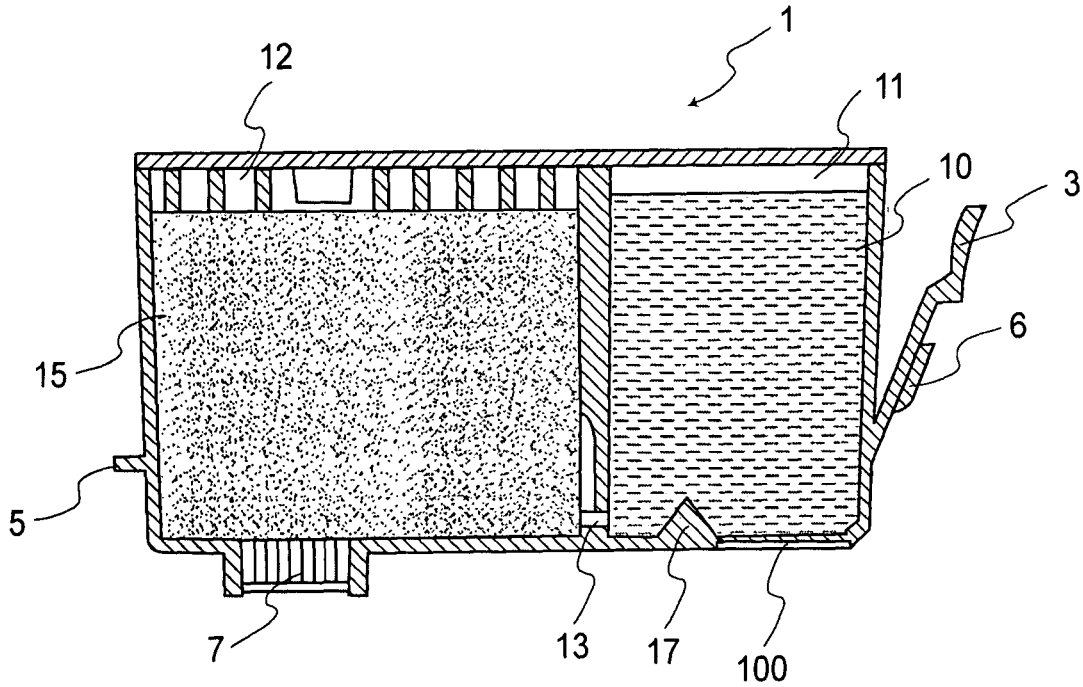
FIG. 12 is a sectional view of one of the color ink cartridges 1 in the fourth embodiment of the present invention, at a plane parallel to the lateral walls of the container.

FIG. 12 is a sectional view of one of the color ink cartridges 1 in the fourth embodiment of the present invention, at a plane parallel to the lateral walls of the container. In this embodiment, the recording liquid container is provided with a target portion 17 used for detecting the amount of the ink remainder in the recording liquid container. Otherwise, the recording liquid container in this embodiment is the same in structure as those in the preceding embodiments.

Figure 13:
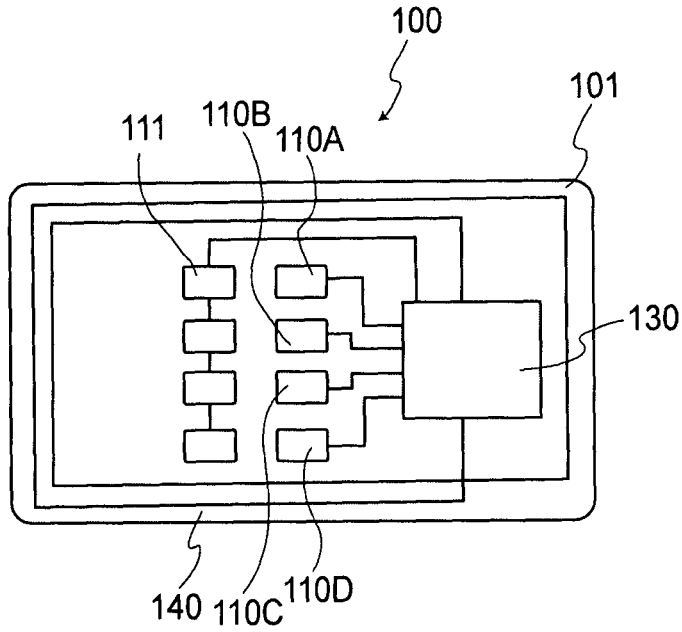
FIG. 13 is a schematic plan view of the IC module, depicting the structure thereof.

FIG. 13 is a schematic plan view of the IC module, and is for depicting the structure of the IC module. The IC module 100 is made up of: a base sheet 101 formed of film of PET (polyethyleneterephthalate) or PEN (polyethylenenaphthalate), or the like; a circuit chip 130; and an antenna 140 formed of copper foil, aluminum foil, or the like material. The circuit chip 130 and antenna 140 are attached to the base sheet 101, and are laminated with a cover sheet.

The cover sheet is provided with an opening, through which electrical contacts, more specifically, common electrodes 111, individual electrodes 110A, 110B, 110C, and 110D, which are in connection with the circuit chip 130, are exposed.

Figure 14:
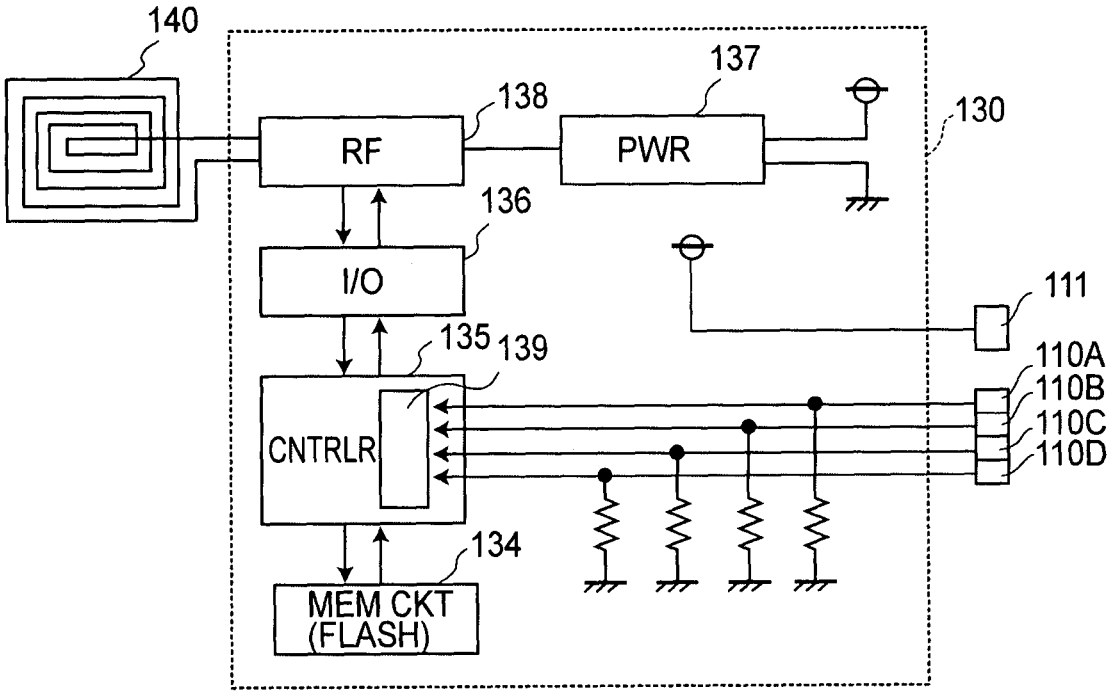
FIG. 14 is a block diagram of the circuit chip, showing the internal structure thereof.

FIG. 14 is a block diagram of the circuit chip 130, and is for depicting the internal structure of the circuit chip 130. The circuit chip 130 is made up of primarily a RF circuit 138, an electric power circuit 137, an input/output circuit 136, a control circuit 135, a storage circuit 134 as information storage medium, which is a flash memory or the like.

The RF circuit 138 is a circuit which detects the AC signals which are electromagnetically induced in the antenna 140, and inputs the AC signals into the circuit chip 130. That is, it outputs the power component extracted from the AC signals, into the power source circuit 137, and the signal components extracted from the AC signals into the input/output circuit 136. The RF circuit 138 also has the function of receiving signals from the input/output circuit 136, changing the signals into AC signals by modulation, and then, transmitting the AC signals to the recording apparatus main assembly, through the antenna 140.

The antenna 140, RF circuit 138, and electric power circuit 137 generates electric power by electromagnetic induction, and the input/output circuit 136 transmits or receives the information of the preselected type, over radio wave, using the electric power supplied by the electric power circuit 137. The control circuit 135 also controls the internal operations, such as reading the information in the storage circuit 134, or writing information into the storage circuit 134. The storage circuit 135 stores information unique to each recording liquid container, for example, the data for identifying the product type of a recording liquid container having the same circuit chip as the circuit chip 130, data for identify the product type of the main assembly of a recording apparatus, data for the UID of a recording liquid container, production date, expiration date (expiration date of ink), amount of the ink remainder, etc.

The common electrodes 111 located outside the circuit chip 130 are in connection with the electric power source, in the circuit chip 130. The individual electrodes 110A-110D are in connection with the control circuit 135 in the circuit chip 130, and are grounded through preselected resistors. When an individual electrode 110 is not in connection with the common electrode 111, the potential level of this individual electrode is the same as that of the ground. On the other hand, as the individual electrode 110 is connected to the common electrode 111, the electrical potential level of the individual electrode becomes the same as that of the electric power source. The control circuit 135 has a built-in encoder circuit 139 as a means for detecting the electric potential levels at the abovementioned individual electrodes 110A-110D. Thus, the control circuit 135 can obtain the electric potential level of each individual electrode, that is, the state of connection, as logic data.

Figure 15:
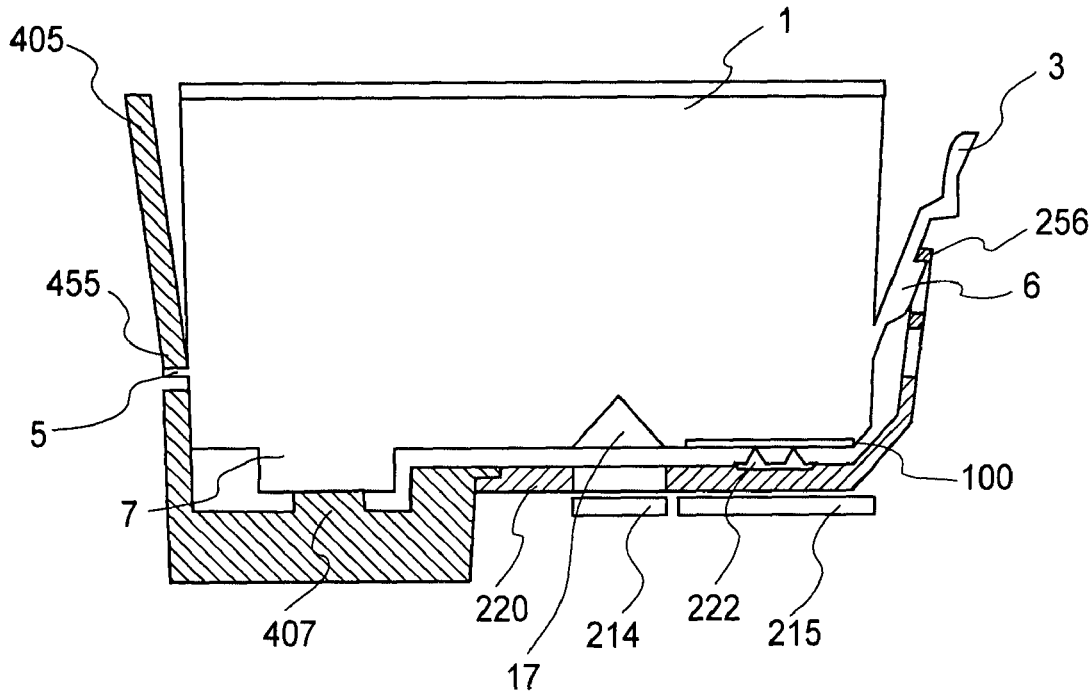
FIG. 15 is a sectional view of the ink cartridge which is in its proper position in the ink cartridge holder which is in its proposition on the carriage, at a plane parallel to the lateral walls of the container.

FIG. 15 is a sectional view of the ink cartridge described above, which is in its proper position relative to the recording head unit 405 which is in its proper proposition on the carriage 205, and an ink cartridge holder 220, at a plane parallel to the lateral walls of the container. The first engaging portion 5 engages with a first engaging portion 455 with which a recording head unit 405 is provided, and the second engaging portion 6 engages with a second engaging portion 256 with which the ink cartridge holder 220 is provided. With the engagement between the first and second engaging portions 5 and 6 of the recording liquid container 1, with the first and second engaging portions 455 and 256, respectively, the recording liquid container 1 is firmly held to the head unit 405 and ink cartridge holder 220, and the ink outlet 7 of the ink cartridge is coupled with the ink inlet 407 through which ink is drawn to the recording head.

The ink cartridge holder 220 is provided with a connective member 222, which is positioned so that it opposes the IC module 100 of the ink cartridge 1. As the ink cartridge 1 is mounted, the connective member 222 electrically connects the common electrode and individual electrode, by coming into contact with a part of the common electrode and a part of the individual electrode 110. In this embodiment, four ink cartridges are juxtaposed in parallel in the ink cartridge holder 220, which has four connective members 222, which are different in the positional relationship relative to the ink cartridge holder 220. For example, the four connective members 222 can be positioned so that as an ink cartridge is mounted into the slot for the ink cartridge 1K, the individual electrode 110A is connected to the corresponding common electrode; as an ink cartridge is mounted into the slot for the ink cartridge 1C, the individual electrode 110B is connected to the corresponding common electrode; as an ink cartridge is mounted into the slot for the ink cartridge 1M is mounted, the individual electrode 110C is connected to the corresponding common electrode; and as an ink cartridge is mounted into the slot for the ink cartridge 1Y is mounted, the individual electrode the 110D is connected to the corresponding common electrode. In other words, the four connective members 222 can be positioned so that the four cartridge slots are different in the individual electrode which is connected to the common electrode as an ink cartridge is mounted. Therefore, the control circuit 135 of each ink cartridge can detect the position of the ink cartridge (to which it belongs) on the ink cartridge holder, based on the state of connection, as soon as the ink cartridge is mounted.

Incidentally, in this embodiment, whether or not each ink cartridge in the ink cartridge holder is correct in position is checked by the control circuit 135. However, this arrangement is not intended to limit the present invention in scope. For example, whether or not each ink cartridge in the ink cartridge holder is correct in position may be determined by the CPU 301 with which the control circuit 300 of the main assembly of the recording apparatus, as will be described later.

The ink cartridge holder 220 is provided with a communication unit 215 which wirelessly communicates with the IC module of the ink cartridge, and a light emitting-receiving portion 214 which optically detects the presence or absence of ink with the use of the target portion 17. The communication unit 215 and light emitting-receiving portion 214 are on the bottom surface of the ink cartridge holder 220. They may be formed as integral parts of the carriage, or may be solidly fixed to the portion, such as the home position or ink cartridge replacement position, of the carriage, which are in the adjacencies of the moving path of the carriage. No matter which structural arrangement is employed, the information obtained by the communication unit 215 and target portion 17 is sent to the control circuit 300 of the main assembly of the printer.

The light emitting-receiving portion 214 is an optical sensor having a light emitting element and a light receiving element. It detects the presence or absence of ink in the ink chamber 11 by detecting the target portion 17 which is formed of transparent or semitransparent substance. Therefore, the ink cartridge holder 220 is provided with a hole, which is positioned so that the light which the light emitting-receiving portion 214 emits or receives to detect the target portion 17 is not blocked by the ink cartridge holder 220. For example, if the ink chamber 11 becomes empty, the light emitted by the light emitting-receiving portion 214 is reflected back to the light receiving portion of the light emitting-receiving portion 214 by the surface of the target portion 17 which is in the form of a prism. On the other hand, as long as the ink chamber 11 is full of ink, the light emitted by the light emitting-receiving portion enters the ink chamber 11, and does not return to the light emitting-receiving portion. The signals outputted by the light emitting-receiving portion 214 are sent to the control circuit 300, which obtains the information regarding the amount of the ink remainder, based on these signals.

The communication unit 215 is capable of communicating with the IC module 100 with which each ink cartridge is provided, and the control circuit 300 is capable of exchanging various information with the IC module 100 of each ink cartridge, through the c communication unit 215. For example, the state of contact of the individual electrode 110 of each of the four ink cartridges is detected, and if no contact is detected, it is determined that no ink cartridge is on the carriage.

It was previously stated that the communication unit 215 may be attached to the carriage, or there may be a certain amount of distance between the communication unit 215 and carriage. In this embodiment, however, it is desired that the positional relationship between the carriage 205 and communication unit 215 is such that when the carriage 205 is in the ink cartridge replacement position, wireless communication can be satisfactorily made between the communication unit 215 and the IC 100 of each ink cartridge, for the following reason. That is, with the positional relationship between the carriage 205 and communication unit 215 being as described above, the control circuit 300 is enabled to obtain the information which the IC module of each ink container has obtained regarding the position of the ink cartridge relative to the carriage 205 and the correctness or incorrectness of the position, as soon as each ink cartridge is mounted on the carriage 205, that is, without moving the carriage 205 in a manner to scan recording medium. In other words, unlike the embodiment disclosed in Japanese Laid-open Patent Application 2004-338394, this embodiment makes it unnecessary to open or close the main assembly cover, or intermittently move the carriage 205 in a manner to scan recording medium, in order to determine whether or not the ink cartridges are correct in their positions relative to the carriage 205. Therefore, if any of the ink containers has been incorrectly mounted, the user can be informed of the error, and can be instructed to correctly mount the ink container, at the point in time at which the use finishes mounting the ink cartridges.

Figure 16:
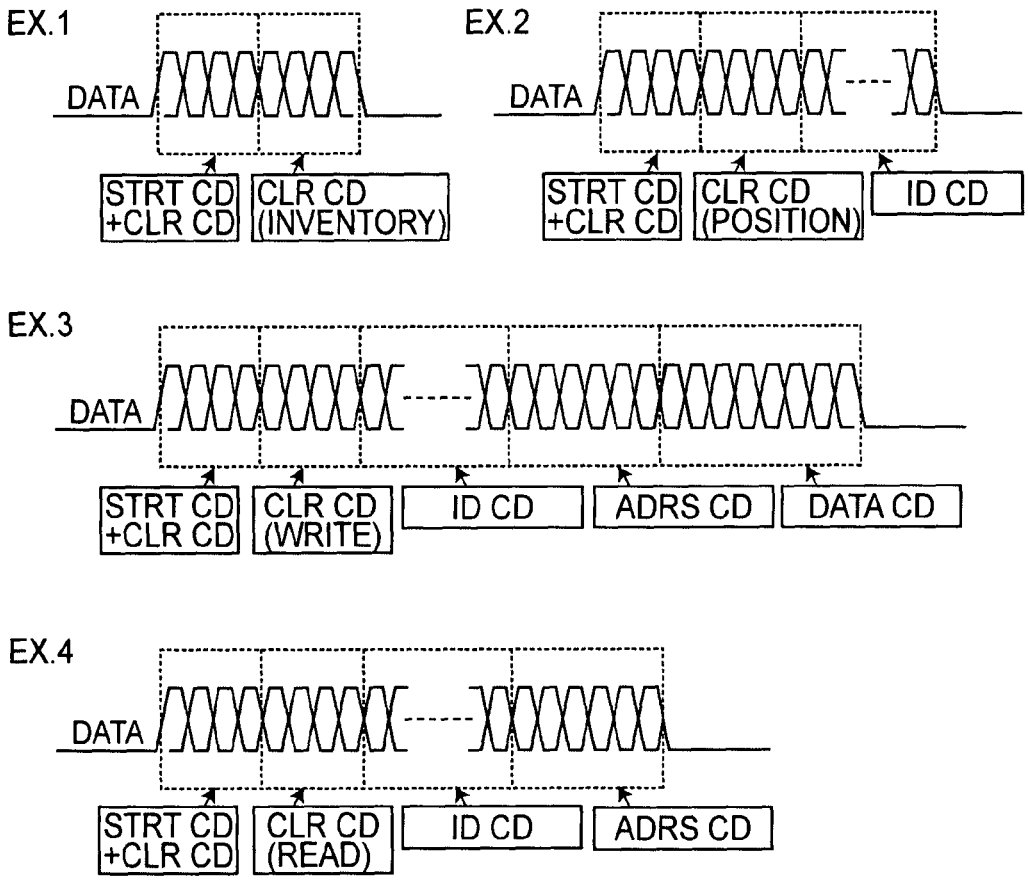
FIG. 16 is a schematic drawing of the data, showing the structure of the data carried by the command transmitted by the communication unit of the main assembly to access the IC module of a specific ink cartridge in the main assembly.

FIG. 16 is a schematic drawing of the access data which the communication unit 215 transmits to the IC module, and is for describing the structure of the data.

Example 1 is the access data for confirming the unique identification data of the ink cartridge. In this example, the unique identification data is made up of two data signal sections, that is, "start code+color code" section and "control code" section. The "start code+color code" section includes "start code" which indicates the starting point of the data signal sequence, and "color code" which specifies the color of the ink in the ink cartridge, which the subsequent portion of the data signal sequence concerns. The "color code" can be changed in configuration (pattern) so that not only can it indicate each of colors Y, M, C, and K, but also, various density levels of ink.

The control circuit 135 in the IC module 100 compares the color information which the received color code indicates, with the color information in its storage circuit 134. The control circuit 135 continues the process of accessing the data only when the two color information match. If the two pieces of information do not match, the control circuit 135 ignores the subsequent data. With this arrangement, that is, with the abovementioned color information included in the access data, even if the same data signals are sent to each of the multiple ink cartridges juxtaposed in the ink cartridge holder, only the ink cartridge which matches in color code with the access data can process the subsequent data.

In the step in which the UID are read, "start code+color code" section are read by the IC module of all the ink cartridges. However, "INVENTORY" section is read only by the control circuit 135 (FIG. 3) of the ink cartridge whose color code matches the color code section of the "start code+color code" transmitted by the communication unit 215. The control circuit 135 which accepted the "INVENTORY" code section replies by transmitting the UID stored in the storage circuit 134. The process of transmitting the access data from the communication unit 215, and the process of transmitting the reply from the control circuit 135 are sequentially repeated for all colors to obtain the UID of each of the multiple ink cartridges juxtaposed on the carriage.

Example 2 shows the structure of the access data for detecting the position of each ink cartridge on the carriage, relative to the carriage. This access data is made up of "start code+color code", "control code", and "UID code" sections. Incidentally, "UID code" does not need to be included in the command.

When the carriage is in the ink cartridge position detecting position, the control circuit 135 of only the ink cartridge whose "color information" matches with that in the access data takes in "POSITION" code. Further, "UID code" made up of a preset number of bits may be included in "POSITION" code so that the control circuit 135 of only the ink cartridge whose UID matches the UID code included in "POSITION" code is allowed to process the data transmitted thereafter. The control circuit 135 which has accepted "POSITION" code replies by transmitting the positional information obtained from the potential level s of the four individual electrodes 110A-110D.

Example 3 shows the structure of the access data for writing information into the storage circuit 134. The codes in this example is made up of "start code+color code", "control code", "UID code", "address code", and "data code" sections.

In the writing step, the commands are taken in by all the IC modules 100 of the ink cartridges, and only the control circuit 135 of the ink cartridge whose "color code" agrees with the color code in the access data accepts "WRITE" code and the codes thereafter. The "UID code" made up of a preset number of bits may be included in "WRITE" code so that the control circuit 135 of only the ink cartridge, the UID of matches the UID code in the access data is allowed to process the data transmitted thereafter. The next section, or "address" code section shows the address of the portion of the memory array, into which data is to be written. The last section, or "data code" section indicates the information to be written.

Incidentally, the contents of "control code" section are not limited to those mentioned above. For example, a "continue write" command, a "verify" command may be included. Further, the "WRITE" command may separately includes a code which does no have "UID" code, that is, a code (such as "WRITE-ALL" (unshown)) which is writable in all the accessible IC modules.

Example 4 is the structure of the access data for reading from the storage circuit 134. In terms of data structure, Example 4 is the same as Example 3, or the example of access data for writing, and only the control circuit 135 of the ink cartridge whose "color" code and "UID" code match those in the access data internally processes data in response to "READ" command. The control circuit 135 reads the data in the portion of the storage circuit 134, which is specified by the address code, and transmits the obtained data as reply.

While the communication unit 215 and IC module 100 communicate with each other as described above, the newest information regarding each ink cartridge and an update flag are retained in the RAM 302 of the control circuit 300 of the main assembly of the printer. It is the CPU 301 that sets an update flag in the ROM 302 as a command, such as those mentioned above, comes in, or an event, such as the detection of the ink remainder amount, which requires updating of information, occurs. The CPU 301 monitors the update flag to update the information as necessary, and resets the update flag after the completion of the updating process.

Figure 17:
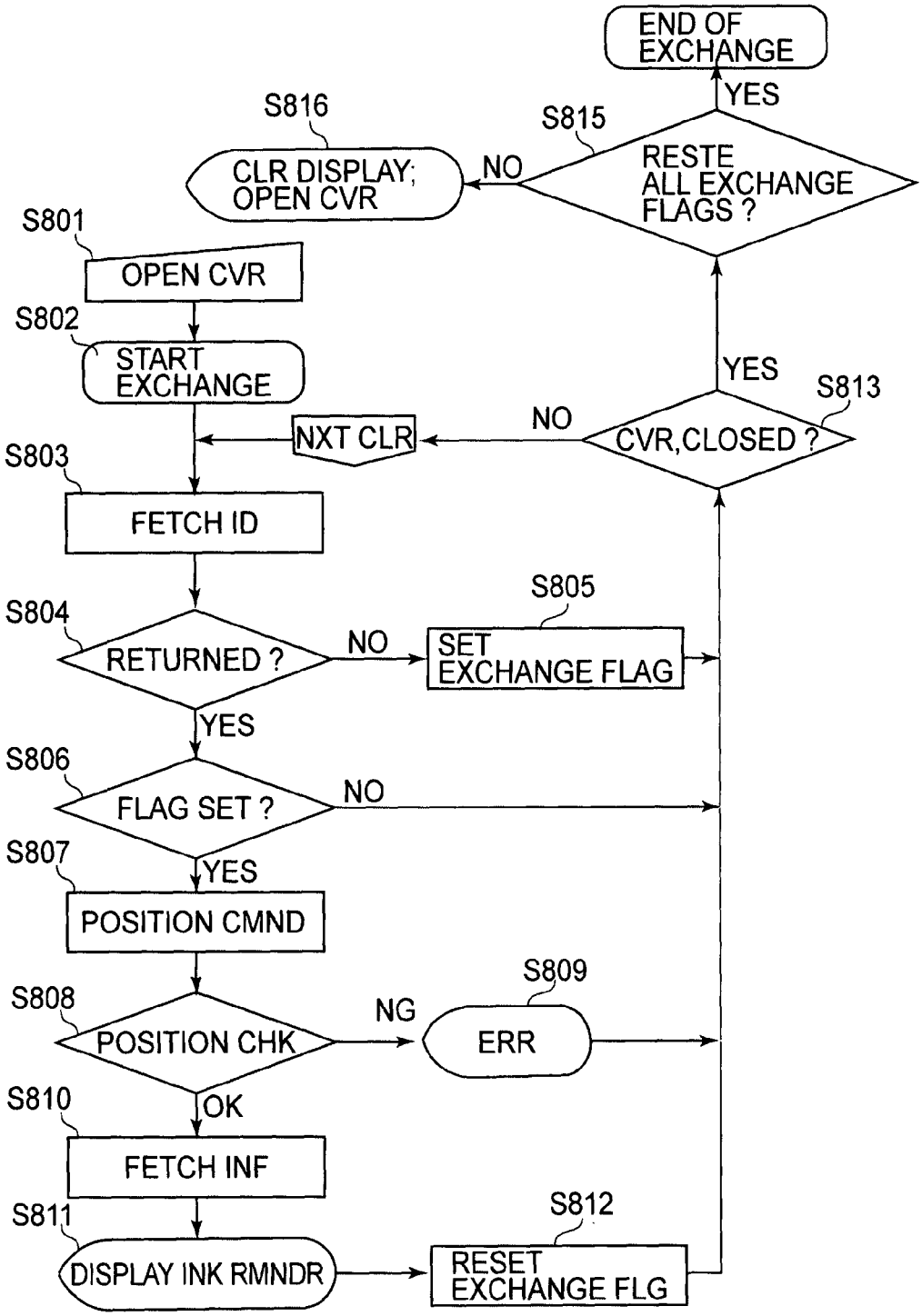
FIG. 17 is a flowchart of the operational sequence for mounting an ink cartridge into the main assembly of the recording apparatus.

FIG. 17 is a flowchart of the sequence which the CPU 301 carries out when a user mounts the ink cartridge 1 in this embodiment onto the carriage 205. It is to be presumed here that in this embodiment, it is in the final step in the process for manufacturing the ink cartridge 1 that various data, such as the product type identification data are stored in the storage circuit of the ink cartridge 1.

As a user opens the main assembly cover 201 to mount an ink cartridge 1, a sensor detects the opening of the cover 201 (S801).

As the CPU 301 receives the signal from this sensor, it starts the ink cartridge replacement sequence. First, it moves the cartridge 205 to the ink cartridge replacement position shown in FIG. 5 (S802).

As the user attaches an ink cartridge 1 (which user thinks is correct one) to the carriage 205, the corresponding connective member 222 of the main assembly of the printer becomes connected with the IC module, and electric power is supplied to the circuit chip from the electric power circuit of the IC module, making it possible for the communication unit 215 to communicate with the ink cartridge 1 as soon as the connection is completed.

The communication unit 215 transmits to all of the four ink cartridges on the carriage, the command for obtaining the UID of the first color. The IC module of the ink cartridge whose color code matches code of the first color transmits the UID in response to the command for obtaining the UID, and the CPU 301 confirms the presence or absence of the reply(s) from the ink container(s) (S804). In this step, it is determined whether or not the ink cartridges for this color on the carriage can communicate.

If the CPU cannot obtain the UID, it determines that there is no ink cartridge which matches the first color, and sets a replacement flag in the RAM 302, which is one type of an update flag and is assigned to each ink color (S805). On the other hand, if it obtains the UID, it advances to S806, in which it checks whether or not the replacement flag has been set in the RAM 302. If the replacement flag has not been set, that is, if the ink cartridge which was on the carriage before the opening of the main assembly cover is still on the carriage, the CPU determines that the process for updating the data is unnecessary, and ignores the process thereafter. Then, it skips to S813.

If the CPU determines in S806 that the replacement flag has been set, it determines that a replacement ink cartridge has been mounted, and transmits the command for obtaining the position of this replacement ink cartridge (S807). Upon receiving the command for obtaining the position of the replacement ink cartridge, the control circuit 135 transmits the positional information, which can be obtained from the state of contact of the individual electrode. As the CPU receives this positional information, it compares this information with the information in the RAM 302 as an information holding means, that is, the correct position for this replacement ink container (S808).

If the result of the comparison is NG, that is, the CPU determines that the replacement ink cartridge is in the wrong slot, the CPU conveys this information to the user using such means as the display of the main assembly of the printer or the host computer (S809). If the result of the comparison is OK, that is, the replacement ink cartridge is in the correct slot, it advances to S810.

In S810, the CPU reads various information, in the storage circuit 134, which is specific to this replacement ink cartridge, for example, the amount of the ink remainder in the ink cartridge. Then, it advances to S811, in which it displays, if necessary, the amount of the ink remainder in the replacement ink cartridge, using the display of the main assembly of the printer, or the printer driver of the host computer (S811). After the completion of the communication sequence described above, the CPU advances to S812, in which it resets the replacement flag which is in its set position (S812), ending the communication related to this ink color.

In the next step, or S813, the CPU determines whether or not the main assembly cover 201 is open. If it determines that the main assembly cover 201 is open, it switches to the next color (S814), and returns to S803, in which it starts the above described sequence, for the next color.

On the other hand, if the CPU determines that the main assembly cover 201 is closed, it advances to S815, in which it monitors all the replacement flags (one for each color) in the RAM 302. If no replacement flag is in the set position, the CPU determines that all of the four ink cartridges (one for each color) are in the normal in terms of the position and state of positioning, and ends the sequence. Then, it puts the printer on standby.

If the CPU detects the replacement flags, it determines that the ink cartridge replacement process is incomplete, and displays the error message, prompting reopening of the cover (S816).

Incidentally, the information regarding the UID transmitted in S803 and S804 may include the information, such as the ink cartridge position, exchanged in S807 and S808. In such a case, the two commands can be differentiated by making the two different in transmission timing and carrier wave frequency, when transmitting in succession the command for obtaining the UID and the command for obtaining ink cartridge position. Also in such a case, as the IC module 100 receives the two commands, it transmits the ink cartridge position in addition to the UID data. If the UID and ink cartridge position can be obtained at the same time as described above, even if two or more ink cartridges which are the same in ink type are mounted by mistake, the replies from the ink cartridges do not interfere with each other.

One of the distinctive features of the preceding embodiments described above is that the contact between an ink cartridge and the ink cartridge holder of an ink jet recording apparatus, which occurs when the ink cartridge is mounted into the ink cartridge holder, ensures that the position of the ink cartridge is accurately detected. This feature is realized by the logic structure in the relationship which occurs between the electrodes of the IC module and the connective members of the ink cartridge holder. That is, unlike the control circuit of the ink jet recording apparatus disclosed in Japanese Laid-open Patent Application 2003-159808, the control circuit of the main assembly of the recording apparatus in each of the above described embodiments of the present invention does not require the carriage to be moved to find the positions of the multiple ink cartridges in the apparatus main assembly (relative to carriage), making it possible to instantly determine the positions of the ink cartridges, based on the information wirelessly transmitted from the IC module of each ink cartridge, when the ink cartridges are mounted. Further, the information received at this point in time contains both the directly obtained information regarding the cartridge position and UID. Therefore, the vagueness in the match between the position of a given ink cartridge and the information regarding the identity of this cartridge, which was presented as the problem which the ink jet recording apparatus disclosed in Japanese Laid-open Patent Application suffers, can be eliminated. Therefore, it is possible to reliably detect the position of a cartridge in the main assembly of the ink jet recording apparatus, and the correctness of the engagement between the ink cartridge and carriage.

It is stated that in this embodiment, it is desired that when the carriage 205 is at the ink cartridge replacement point, wireless communication can be satisfactorily made between the communication unit 215 and the IC module 100 of each ink cartridge. However, this statement is not intended to limit the present invention in scope. For example, even if it is required to move the carriage out from the ink cartridge replacement position in order to make wireless communication possible, the requirement does not affect the fact that the position of each ink cartridge can be reliably detected without intermittently moving the carriage.

Embodiment 5

Next, the fifth embodiment of the present invention will be described. The external appearance of the main assembly of the printer in the fifth embodiment is the same as that in the second embodiment, which was described with reference to FIG. 8.

Figure 18:
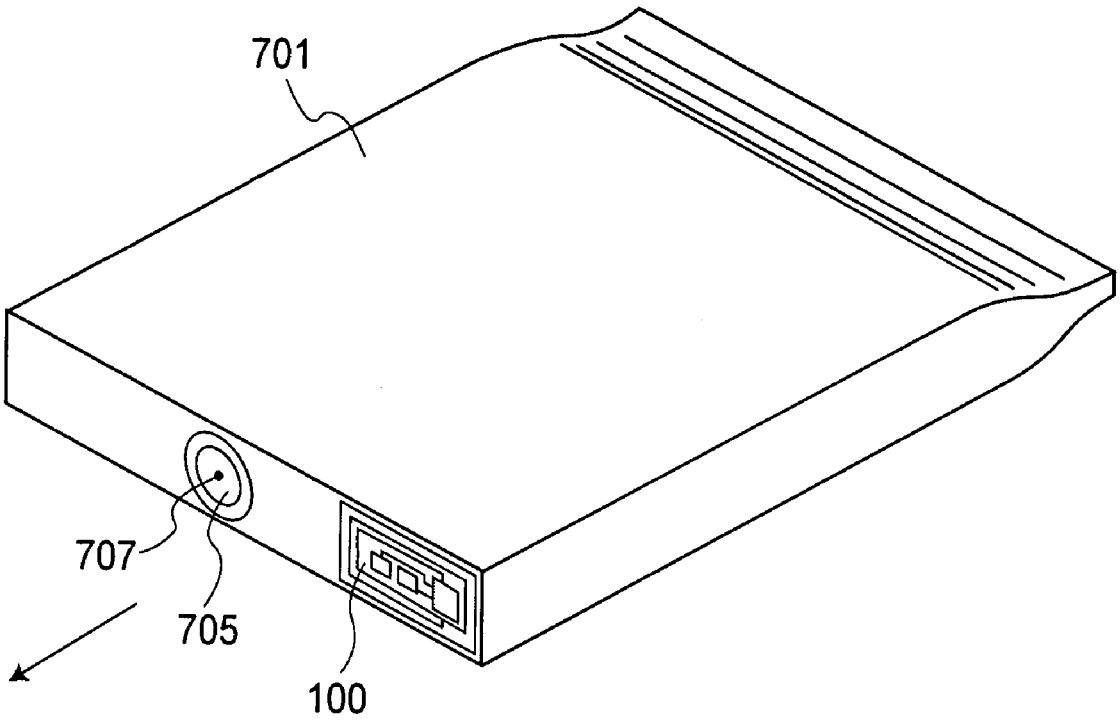
FIG. 18 is a schematic perspective view of the ink cartridge in the fifth embodiment of the present invention.

FIG. 18 is a schematic perspective view of the ink cartridge 701 in the fifth embodiment of the present invention. The ink cartridge 701 is provided with an ink outlet 707 through which ink is supplied to an ink tube connected to the ink cartridge. The ink outlet 707 is a part of the bottom wall of the ink cartridge 701, and the IC module 100 is attached to the bottom surface of the ink cartridge 701. As the ink cartridge 701 is inserted into the ink cartridge chamber of the main assembly of the printer, in the direction indicated by an arrow symbol, the ink outlet 707 of the recording liquid container 701 couples with the needle-like ink drawing member (unshown), with which the main assembly of the printer is provided, making it possible for the ink in the recording liquid container 701 to be supplied to the recording head. The internal space of the hollow ink container proper of the ink cartridge 701 in this embodiment is not filled with a porous member; ink is directly stored in the ink container proper. In order to prevent the ink (liquid) from leaking from the ink outlet 707, the ink outlet 707 is kept sealed with a flexible sealing member 705.

In this embodiment, an IC module 100 similar to the one in the fourth embodiment, which was described with reference to FIGS. 13 and 14, can be employed. The main assembly of the printer in this embodiment is provided with connective members (unshown) which are similar in function to the connective members in the fourth embodiment. The connective members are different in pattern. Each of the connective members is positioned so that it opposes the IC module of the corresponding ink cartridge. Further, the main assembly of the printer is provided with a communication unit (unshown), which is also similar to that in the fourth embodiment. The communication unit is located in the adjacencies of the ink drawing member of the main assembly.

As the ink cartridge is mounted, the corresponding connective member, which is different in pattern from the other connective members, makes an electrical connection between the common electrode and individual electrode of the IC module 100 of the mounted ink cartridge. The IC module measures the potential level of the individual electrode, and sends the obtained information (regarding potential level) is to the controlling apparatus of the main assembly through the communication unit. In this embodiment, the design of the ink jet recording apparatus is such that unless the needle-shaped member of the printer main assembly sufficiently penetrates the ink cartridge 701 when the ink cartridge 701 is mounted, the connective member is not allowed to contact the various electrodes of the corresponding ink cartridge. Therefore, if the ink cartridge 701 fails to be insert into a preset position which ensures that ink is reliably supplied to the recording head, because of the errors in the shapes of the printer main assembly and/or ink cartridge 701, and/or the presence of play, a user can be prompted to insert the ink cartridge 701 further so that the ink cartridge 701 reaches the preset position.

In this embodiment, the ink cartridge replacement sequence similar to the one in the fourth embodiment, which is shown by the flowchart in FIG. 17, can be employed. That is, as soon as the main assembly cover 601 is closed, it is checked whether or not all of the four different ink cartridges in the printer main assembly are correct in position. Then, as it is determined that all the ink cartridges are correct in position, the preset preparatory sequence for printing is carried out, and then, the recording apparatus is put on standby.

In the immediately preceding two embodiments described above, the control circuit 300 of the printer main assembly transmitted the command for obtaining the ink cartridge position (S807), and then, compared the obtained ink cartridge position with the cartridge position stored in the RAM 302 (S808). However, this sequence is not intended to limit the present invention in scope. This sequence may be replaced with such a sequence that the IC module detects the actual cartridge position in response to the request from the control circuit 300, compares the detected cartridge position to the cartridge position stored in its own storage circuit, and sends the results of comparison to the control circuit 300.

Also in the preceding two embodiments, a flash memory was employed as the storage circuit 134 of the IC module of the ink cartridge 1 so that information can be updated, and the control circuit 300 of the printer main assembly reads the information in the storage circuit 134, or writes information of the preselected type into the storage circuit 134, through the communication unit 215. However, this setup is not intended to limit the present invention in scope. For example, an EEPROM, a FeRAM, a RAM connected to a battery, a ROM which unalterably stores preselected information, etc., may be employed as the storage means for the IC module 100. If a ROM is employed, the information cannot be updated, and therefore, the control circuit 300 of the printer main assembly can read the preselected information in the storage means of the ink cartridge 1, through the communication unit 215, but, cannot write information into the storage means.

Also in the preceding two embodiments, the IC module 100 with which each ink cartridge is provided is provided with the electric power generating means, which is made up of the antenna 140, RF circuit 138, and electric power source circuit 137, and electric power is generated by electromagnetic induction. However, electric power may be generated by using the electric field energy of microwave, or the IC module may be provided with its own battery. The employment of any of such methods does not affect the effectiveness of the present invention at all.

Further, the present invention is applicable even if an ink cartridge is different in internal structure from the ink cartridges in the preceding two embodiments. For example, the present invention is compatible with an ink cartridge which employs, as the negative pressure generating means, a pouch formed of an elastic substance, such as rubber, instead of an ink absorbing member. In such a case, an elastic pouch is formed so that the elasticity of the elastic substance acts in the direction to expand the pouch, and ink is directly filled into the pouch. Thus, as the ink in the pouch is consumed, negative pressure is generated in the pouch by the elasticity of the pouch. The present invention is also compatible with an ink cartridge having an ink chamber, the walls (at least part of wall) of which is formed of flexible substance. In this case, the negative pressure is generated by applying outward pressure to the wall (part of wall) with the use of a spring or the like. Also in this case, ink is directly stored in the ink chamber.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 127471/2006 and 149874/2006 filed May 1, 2006 and May 30, 2006, respectively which are hereby incorporated by reference.

What is claimed is:

1. A recording apparatus to which a recording liquid accommodating container having a recording liquid accommodating portion is mountable, wherein said recording liquid accommodating container includes communicating means for bi-directional wireless communication with said recording apparatus, said recording apparatus includes a communication antenna for wireless communication with said communicating means;

said communication antenna and said communicating means are constructed to be disposed opposed to each other with said recording liquid accommodating portion interposed therebetween, and it is discriminated depending on a state of wireless communication between said communication antenna and said communicating means whether or not a remaining amount of the recording liquid in said recording liquid accommodating portion is not more than a predetermined amount, wherein said communicating means wirelessly receives a signal from said communication antenna and returns a signal in response to the received signal, and wherein the remaining amount of the recording liquid is discriminated as being not more than the predetermined amount when a ratio of a number of the signals returned from said communicating means sent in response to the wirelessly received signals to a number of the signals sent from said communication antenna is larger than a predetermined threshold.

2. An apparatus according to claim 1, wherein said recording liquid accommodating container includes an information memory medium for storing information relating to the recording liquid, and said communicating means is capable of wireless communication with said recording apparatus to permit said recording apparatus to read the information out of said information memory medium or to permit said recording apparatus to write the information in said information memory medium, wherein said recording apparatus includes an information communication antenna for wireless communication with said communicating means to permit said recording apparatus to read the information out of said information memory medium or to permit said recording apparatus to write the information in said information memory medium, and wherein said information communication antenna is disposed to be in proximity with said communicating means at the same side as said communicating means with respect to said recording liquid accommodating portion.

3. An apparatus according to claim 2, further comprising selecting means for selecting either said communication antenna or said information communication antenna.

4. An apparatus according to claim 2, wherein a plurality of such recording liquid accommodating containers are mountable in a juxtaposed fashion, and wherein said communication antenna is disposed at a position vertically below each of said recording liquid accommodating portions, and said information communication antenna is disposed at a position vertically above each of said recording liquid accommodating portions, said apparatus comprising selecting means for selecting either said communication antennas or said information communication antennas.

5. An apparatus according to claim 2, wherein a plurality of such recording liquid accommodating containers are mountable in a juxtaposed fashion, and wherein said communication antenna is disposed at a position vertically above each of said recording liquid accommodating portions, and said information communication antenna is commonly for said recording liquid accommodating containers and is disposed on feeding means which is capable of passing vertically below said recording liquid accommodating portions, said apparatus comprising selecting means for selecting either said communication antennas or said information communication antennas.

6. A recording apparatus according to claim 1, wherein a plurality of such recording liquid accommodating containers are mountable in a juxtaposed fashion, and a width of said communication antenna measured in a direction in which said recording liquid accommodating containers are arranged is smaller than a width of bottom side of said recording liquid accommodating portion measured in the direction in which said recording liquid accommodating containers are arranged.

7. A recording apparatus to which a recording liquid accommodating container having a recording liquid accommodating portion is mountable, wherein said recording liquid accommodating container includes communicating means for bi-directional wireless communication with said recording apparatus, said recording apparatus includes a communication antenna for wireless communication with said communicating means;

said communication antenna and said communicating means are constructed to be disposed opposed to each other with said recording liquid accommodating portion interposed therebetween, and it is discriminated depending on a state of wireless communication between said communication antenna and said communicating means whether or not a remaining amount of the recording liquid in said recording liquid accommodating portion is not more than a predetermined amount, wherein said communicating means wirelessly receives a signal from said communication antenna and returns a signal in response to the received signal, and wherein an output level of the signal wirelessly sent toward said communicating means from said communication antenna is changed, and the remaining amount of the recording liquid is discriminated as being not more than the predetermined amount when a minimum one of the output levels in response to which said communicating means returns the signals is lower than a predetermined threshold.

8. A recording liquid remaining amount discrimination method comprising:

a sending step of wirelessly sending a signal across a recording liquid accommodating portion of a recording liquid accommodating container mounted to a recording apparatus to communicating means of a recording liquid accommodating portion;

a receiving step of discriminating presence or absence of a reply signal from said communicating means in response to the wirelessly sent signal; and a determining step of determining on the basis of the discrimination of said receiving step whether or not a remaining amount of recording liquid in said recording liquid accommodating portion is not more than a predetermined amount, wherein said sending step includes wirelessly sending the signal of the same signal intensity a plurality of times, and wherein said receiving step includes determining a ratio, to a number of said times, of a number of times in which the reply signals are sent in response to the number of times of the wirelessly sent signal, and wherein said determining step determines that remaining amount of the recording liquid is not more than the predetermined amount, when the ratio is at a predetermined threshold.

9. A recording liquid remaining amount discrimination method comprising:

a sending step of wirelessly sending a signal across a recording liquid accommodating portion of a recording liquid accommodating container mounted to a recording apparatus to communicating means of a recording liquid accommodating portion;

a receiving step of discriminating presence or absence of a reply signal from said communicating means in response to the wirelessly sent signal; and a determining step of determining on the basis of the discrimination of said receiving step whether or not a remaining amount of recording liquid in said recording liquid accommodating portion is not more than a predetermined amount, wherein said sending step includes wirelessly sending the signal of the same signal intensity a plurality of times, and wherein said receiving step includes determining a number of times in which the reply signal is continuously sent in response to the wirelessly sent signals, and wherein said determining step determines that remaining amount of the recording liquid is not more than the predetermined amount, when the number of times of the continuous reply signal is at a predetermined threshold.

10. A recording liquid remaining amount discrimination method comprising:

a sending step of wirelessly sending a signal across a recording liquid accommodating portion of a recording liquid accommodating container mounted to a recording apparatus to communicating means of a recording liquid accommodating portion;

a receiving step of discriminating presence or absence of a reply signal from said communicating means in response to the wirelessly sent signal; and a determining step of determining on the basis of the discrimination of said receiving step whether or not a remaining amount of recording liquid in said recording liquid accommodating portion is not more than a predetermined amount, wherein said sending step includes wirelessly sending the signal of the same signal intensity a plurality of times, and wherein said receiving step includes determining a number of times in which the reply signal is continuously sent in response to the wirelessly sent signals, and wherein said determining step determines that remaining amount of the recording liquid is not more than the predetermined amount, when the number of times of the continuous reply signal is at a predetermined threshold.

11. A cartridge comprising:

a memory medium capable of storing individuality information;

a plurality of electrodes functioning as an electrical contact;

detecting means for detecting a state of a potential of each of said electrodes; and a communication module for wirelessly communicating information relating to the individuality information and to the state of the potential.

12. A cartridge according to claim 11, wherein said detecting means detects the state of the potential which is different depending on a position at which said cartridge is mounted in a cartridge holder.

13. A cartridge according to claim 12, further comprising means for discriminating properness of the position at which said cartridge is mounted in the cartridge holder on the basis of the individuality information and the state of the potential.

14. A cartridge according to claim 11, wherein said cartridge accommodates ink, and the individuality information includes a kind of the ink.

15. A cartridge according to claim 14, wherein the individuality information includes an expiration time of the ink.

16. A cartridge according to claim 14, wherein the individuality information includes information relating to the remaining amount of the ink.

17. A cartridge according to claim 11, wherein said communication module sends and receives the information relating to the individuality information and to the state of the potential, and said memory medium is capable of storing the information received.

18. A cartridge according to claim 11, wherein said communication module sends the information relating to the individuality information and the information relating to the state of the potential at different timing.

19. A cartridge according to claim 11, wherein said communication module sends the information relating to the individuality information and the information relating to the state of the potential with different frequencies.

20. A recording apparatus comprising means for ejecting ink, onto a recording material, supplied from a cartridge as defined in claim 11;

a cartridge holder including a connecting member for establishing conduction of the electrode at each of the plural mounting positions such that states of potentials of the electrodes are different depending on the mounting position when said cartridge is mounted in said cartridge holder;

a communicating unit for wireless communication with said communication module; and information storing means for storing information for discriminating the mounting position of said cartridge on the basis of information received by said communicating unit.

21. An apparatus according to claim 20, wherein said communicating unit is disposed at such a position that it is wirelessly communicatable with said communication module when said cartridge is mounted to said cartridge holder.

22. An apparatus according to claim 20, further comprising means for confirming and notifying properness of the mounting position of said cartridge on the basis of the information relating to a color of the ink included in the individuality information received by said communicating unit and the information stored by said information storing means.

* * * * *